US012569031B2

(12) United States Patent
Donovan et al.

(10) Patent No.: US 12,569,031 B2
(45) Date of Patent: Mar. 10, 2026

(54) SOLE STRUCTURE FOR AN ARTICLE OF FOOTWEAR

(71) Applicant: PUMA SE, Herzogenaurach (DE)

(72) Inventors: Patrick Donovan, Fuerth (DE); Mauro Bonin, Nuremberg (DE); Sidney Fauconnier, Nuremberg (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 18/631,427

(22) Filed: Apr. 10, 2024

(65) Prior Publication Data

US 2025/0318599 A1 Oct. 16, 2025

(51) Int. Cl.
*A43B 13/14* (2006.01)
*A43B 13/12* (2006.01)
*A43B 13/22* (2006.01)

(52) U.S. Cl.
CPC ..... *A43B 13/141* (2013.01); *A43B 13/125* (2013.01); *A43B 13/223* (2013.01)

(58) Field of Classification Search
None
See application file for complete search history.

(56) References Cited

U.S. PATENT DOCUMENTS 7,036,245 B2 * 5/2006 Russell ..... A43B 13/185 36/3 R
8,171,656 B2 * 5/2012 Salminen ..... A43B 23/22 36/31
8,225,534 B2 7/2012 Mueller
8,307,569 B2 11/2012 McInnis
8,424,221 B2 4/2013 Litchfield
8,549,774 B2 10/2013 Meschter
8,713,817 B2 5/2014 Litchfield
9,089,185 B2 * 7/2015 Nishiwaki ..... A43B 13/12
9,241,535 B2 1/2016 Baudouin
9,462,846 B2 10/2016 Litchfield
10,448,704 B2 10/2019 Dupre
10,897,961 B2 * 1/2021 Baucom ..... A43B 13/223
(Continued)

FOREIGN PATENT DOCUMENTS

CN 110381765 B 10/2021
DE 102019208623 A1 12/2020
(Continued)

OTHER PUBLICATIONS

Extended European Search Report (EESR) of European Patent Application 25163680.9 mailed Jul. 21, 2025 (9 pages).

*Primary Examiner* — Jila M Mohandesi
(74) *Attorney, Agent, or Firm* — Quarles & Brady LLP

(57) ABSTRACT

A sole structure for an article of footwear includes a first plate, a second plate and a third plate. The first plate has a first anterior end disposed adjacent a toe end of the sole structure and a first posterior end disposed within a heel region of the sole structure. The second plate has a second anterior end disposed adjacent the toe end and a second posterior end disposed in a midfoot region of the sole structure. The third plate has a third anterior end disposed adjacent the toe end and a third posterior end disposed in the midfoot region. A first cushion is arranged between the first plate and the second plate, and wherein the second plate and the third plate are coplanar in the forefoot region.

20 Claims, 10 Drawing Sheets

(56) References Cited

U.S. PATENT DOCUMENTS

| | | | | |
|---|---|---|---|---|
| 11,000,093 | B2 | 5/2021 | Connell | |
| 11,039,659 | B2 | 6/2021 | Hopkins | |
| 11,096,443 | B2 | 8/2021 | Connell | |
| 11,259,593 | B2 | 3/2022 | Amoako | |
| 11,291,271 | B2 | 4/2022 | Jones | |
| 11,344,078 | B2 | 5/2022 | Bartel | |
| 11,583,032 | B2 | 2/2023 | Weast | |
| 11,659,887 | B2 | 5/2023 | Dupre | |
| 11,659,888 | B2 | 5/2023 | Dupre | |
| 11,937,663 | B2 | 3/2024 | Connell | |
| 2008/0289220 | A1* | 11/2008 | Rivas | A43B 13/141 36/35 R |
| 2012/0180343 | A1* | 7/2012 | Auger | A43B 1/0009 12/146 B |
| 2018/0213886 | A1* | 8/2018 | Connell | A43B 13/184 |
| 2019/0246738 | A1* | 8/2019 | Connell | A43B 13/186 |
| 2020/0367603 | A1 | 11/2020 | Bartel | |
| 2021/0085026 | A1* | 3/2021 | Connell | A43B 13/127 |
| 2021/0145121 | A1 | 5/2021 | Page | |
| 2021/0161250 | A1 | 6/2021 | Conrad et al. | |
| 2021/0169170 | A1 | 6/2021 | Fahmi | |
| 2022/0378147 | A1 | 12/2022 | Bruns et al. | |
| 2024/0074533 | A1 | 3/2024 | Connell et al. | |

FOREIGN PATENT DOCUMENTS

| | | | |
|---|---|---|---|
| EP | 1947970 | B1 | 5/2014 |
| EP | 1954154 | B1 | 9/2015 |
| EP | 2250918 | B1 | 9/2018 |
| EP | 3749130 | A1 | 12/2020 |
| EP | 4072369 | A1 | 10/2022 |
| EP | 3678506 | B1 | 11/2022 |
| WO | 2019157244 | A1 | 8/2019 |
| WO | 2021119070 | A1 | 6/2021 |

* cited by examiner

SOLE STRUCTURE FOR AN ARTICLE OF FOOTWEAR

CROSS REFERENCE TO RELATED APPLICATIONS

N/A

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates generally to an article of footwear that includes a sole structure having a plurality of plates and a plurality of cushions.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, conventional shoes generally have a unitary midsole that extends continuously from a heel region to a forefoot region. Moreover, conventional shoes have a unitary outsole that extends continuously from the heel region to the forefoot region and, when rested upright and unworn, contacts a ground surface in both the heel region and the forefoot region. In addition, many conventional shoes have a single plate that is embedded within the sole structure. As a result, conventional shoes are limited to the properties offered by the heel region and forefoot region having the same midsole and outsole, and the single plate construction. Thus, there is a need for an improved sole structure.

SUMMARY

An article of footwear, as described herein, may have various configurations. In one aspect of the present disclosure, a sole structure for an article of footwear includes a first plate having a first anterior end disposed adjacent a toe end of the sole structure and a first posterior end disposed within a heel region of the sole structure, a second plate having a second anterior end disposed adjacent the toe end and a second posterior end disposed in a midfoot region of the sole structure, and a third plate having a third anterior end disposed adjacent the toe end and a third posterior end disposed in the midfoot region. A first cushion is arranged between the first plate and the second plate. In addition, the second plate and the third plate are coplanar in the forefoot region.

In some embodiments, the second plate and the third plate of the sole structure diverge from one another at a divergent point that is located in the forefoot region. The second plate curves concavely relative to the first cushion between the second anterior end and a transition point that is spaced toewardly from the second posterior end. The second plate curves convexly relative to the first cushion between the transition point and the second posterior end. The transition point is positioned heelward of the divergent point and positioned heelward of a metatarsophalangeal (MTP) point.

In some aspects, a sole structure for an article of footwear includes a first plate extending from a forefoot region to a heel region, a second plate that is coupled to an outsole in the forefoot region, a forefoot cushion that supports an anterior end of the first plate in the forefoot region, and a heel cushion that supports a posterior end of the first plate. A gap is formed between the forefoot cushion and the heel cushion. In addition, the first plate forms a bridge portion that spans a gap in a midfoot region to connect the forefoot cushion to the heel cushion.

In some embodiments, a rib protrudes from the bridge portion along an underside of the first plate. Furthermore, an insole overlies the first plate, the insole and the first plate being retained within a forefoot recess formed in the forefoot cushion and a heel recess formed in the heel cushion. The heel cushion includes a medial arm and a lateral arm that are coupled to a third plate that is disposed between the first plate and the second plate. The second plate contacts a bottom surface of the forefoot cushion and the second plate and the third plate curve concavely relative to the forefoot cushion between a toe end of the sole structure and a divergent point that is located in the forefoot region. In addition, a center of mass point of the article of footwear is positioned in the midfoot region and distanced from the toe end between about 50% and about 60% of a total length of the sole structure.

In some aspects, a sole structure for an article of footwear includes a lateral cushion pod that is engaged with a lateral portion of a first plate and a medial cushion pod that is engaged with a medial portion of the first plate. The first plate has a top surface in contact with a forefoot cushion. A bottom surface of the first plate contacts a second plate adjacent a toe end. In addition, both the first cushion and the second cushion are arranged to be collinear with a center of mass (COM) point of the footwear.

In some embodiments the center of mass point of the article of footwear is positioned in the midfoot region and distanced from the toe end between about 50% and about 60% of a total length of the sole structure. In addition, the first plate and the second plate curve concavely relative to the forefoot cushion between the toe end and a divergent point that that is positioned toeward of the center of mass point. Further, the first plate curves convexly between a transition point and a first posterior end that is located in the midfoot region.

In some embodiments, the first plate includes a first cutout and a second plate includes a second cutout, the first cutout being axially aligned with the second cutout of the second plate. The sole structure has a forward outsole portion that rests on a ground surface and a rearward outsole portion that is cantilevered above the ground surface.

In some aspects, a sole structure for an article of footwear includes a first plate that is disposed in a forefoot region and a heel region, a second plate that is disposed in the forefoot region and extends into a midfoot region, a cushion that is disposed between the first plate and the second plate, and a third plate that is disposed in the forefoot region and extends into the midfoot region. The second plate and the third plate are coplanar in the forefoot region and diverge relative to one another in the midfoot region.

In some aspects, a sole structure for an article of footwear includes a lateral cushion pod that is arranged on a top surface of a first plate adjacent a lateral side of the sole structure, a medial cushion pod that is arranged on the top surface of the first plate adjacent a medial side of the sole structure, and a second plate that is arranged between and contacting a bottom surface of the first plate and an outsole.

In some aspects, a sole structure for an article of footwear includes a toe end, a heel end, and a longitudinal axis that intersects the toe end and the heel end. The sole structure further includes a lateral cushion pod and a medial cushion pod that are disposed on opposing sides of the longitudinal axis, a first plate that is connected to a second plate adjacent the toe end, and a third plate that extends from the toe end into a midfoot region. The first plate has a first posterior end that is disposed between a heel cushion and at least one of the lateral cushion pod and the medial cushion pod. The first plate includes a first cutout and the third plate includes a third cutout that is aligned with and correspond in shape with the first cutout.

In some aspects, a sole structure for an article of footwear includes a lateral cushion pod that is disposed adjacent a lateral side of the sole structure, a medial cushion pod that is disposed adjacent a medial side of the sole structure, and a plate that is disposed between an outsole and an upper of the footwear. The plate includes a lateral leg that supports the lateral cushion pod and a medial leg that supports the medial cushion pod. A recess is formed in the plate between the lateral leg and the medial leg. The lateral cushion pod overhangs an inner lateral edge of the lateral leg and the medial cushion pod overhangs an inner medial edge of the medial leg. An expansion zone spans across the recess between the lateral cushion pod and the medial cushion pod.

In some aspects, a sole structure for an article of footwear includes an outsole, a plate that extends from an anterior-most point to an aft point that is disposed closer to a heel region of the sole structure than the anterior-most point, and a cushion that is disposed between the outsole and an upper of the footwear. The plate curves from the anterior-most point toward a metatarsophalangeal (MTP) point of the sole structure, the MTP point being coplanar with a reference plane extending through a lateral side and a medial side of the sole structure. Further, a center of mass (COM) point of the footwear is located between the aft point of the plate and the reference plane.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
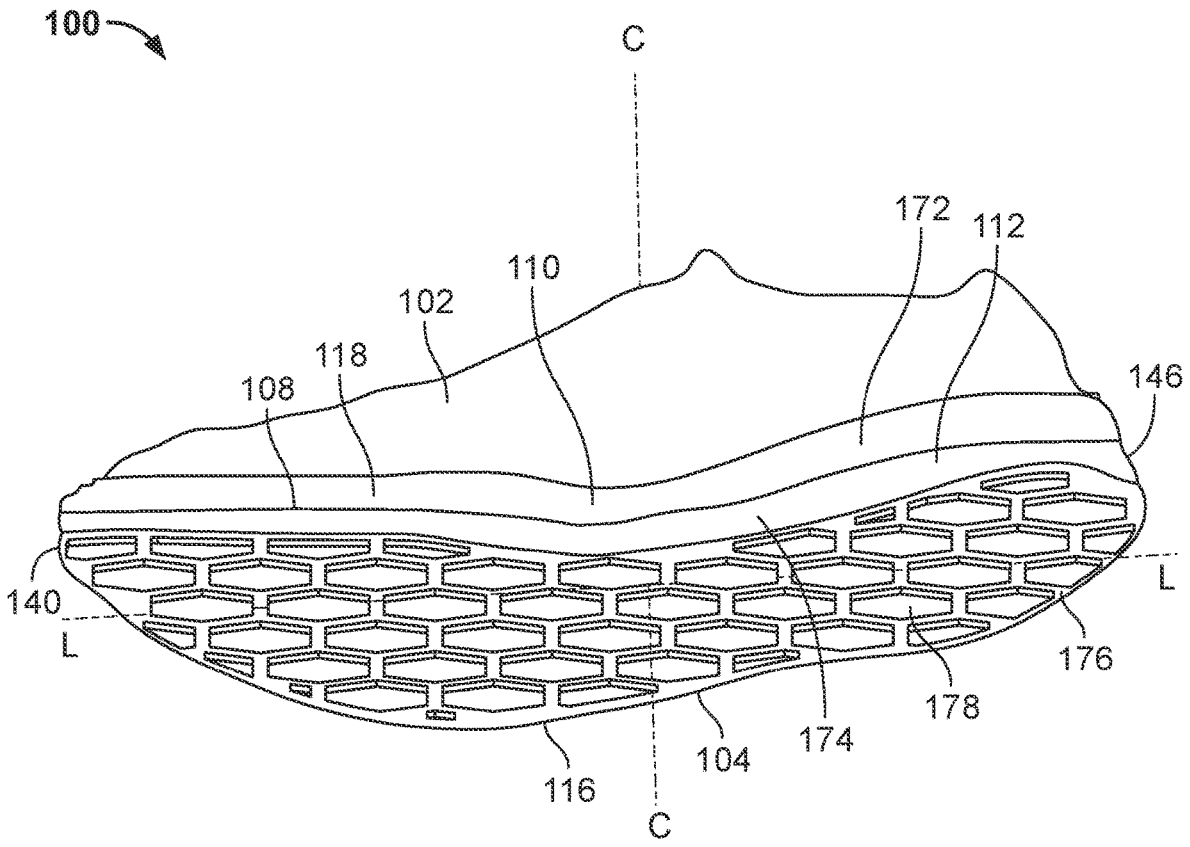
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" can indicate a profile that deviates from a circle to within acceptable manufacturing tolerances.

Unless otherwise specified or limited, the term "substantially" can indicate a variation in one numerical direction relative to a reference value. For example, the term "substantially less" than a reference value (and the like) indicates a value that is reduced from the reference value by 30% or more (e.g., 35%, 40%, 50%, 65%, 80%), and the term "substantially more" than a reference value (and the like) indicates a value that is increased from the reference value by 30% or more (e.g., 35%, 40%, 50%, 65%, 80%).

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations. The terms first, second, third, etc. may be used herein to describe various elements, components, regions, layers and/or sections. These elements, components, regions, layers and/or sections should not be limited by these terms. These terms may be only used to distinguish one element, component, region, layer, or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations.

The present disclosure is directed to an article of footwear or specific components of the article of footwear, such as an upper or a sole or a sole structure. The upper may comprise a knitted component, a woven textile, a non-woven textile, leather, mesh, suede, or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, or other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, or double cloth weaves, for example. Non-woven textiles include textiles made by air-laid or spun-laid methods, for example. The upper may comprise a variety of materials, such as a first yarn, a second yarn, or a third yarn, which may have varying properties or varying visual characteristics.

The present disclosure is related to an article of footwear that includes an upper and a sole structure having a plurality of plates arranged to provide various performance and cushioning effects. In some embodiments, the plurality of plates includes a first plate extending from a forefoot region to a heel region of the footwear to support a user's foot from toe to heel, while a second plate extends from the forefoot region to a midfoot region of the footwear to provide to provide propulsion and energy return during use. The second plate may be coupled to the first plate at an anterior end and configured to flex or bend relative to the first plate during use. A forefoot cushion may be disposed between the first plate and the second plate, such that the first and second plates may be spaced apart from one another between the anterior end and posterior ends thereof. In some embodiments, the first plate and the second plate are coupled at the anterior end by the forefoot cushion. The plurality of plates may include a third plate that is coupled to first plate or the second plate at the anterior end and extends through the forefoot region to the midfoot region or the heel region. Further, the plurality of plates may include a fourth plate that is coupled to the first plate, the second plate, or the third plate and extends through the forefoot region to the midfoot region or the heel region. In some embodiments, the third plate is coupled directly to the second plate and the fourth plate.

In some embodiments, the plurality of plates is arranged with the first plate and the second plate being at least partially coplanar in the forefoot region. In some embodiments, the plurality of plates are arranged with the second plate and the third plate being at least partially coplanar in the forefoot region. In some embodiments, at least two plates of the plurality of plates are not separated by cushions, such as, e.g., the second plate and the third plate. In some embodiments, the plurality of plates are curved from the anterior ends to the posterior ends thereof. For example, the first plate may have a first curvature in the forefoot region and the second plate may have a second curvature in the forefoot region. In some embodiments, the first curvature and the second curvature are different from one another, such that the first plate and the second plate diverge from one another. In some embodiments, the first curvature and the second curvature are identical to one another, such that the first plate and the second plate extend in parallel with one another along at least a portion of their respective lengths.

The sole structure of the present disclosure may include a bifurcated cushion arrangement. In some embodiments, the sole structure includes a forefoot cushion and a heel cushion that are separate and distinct from one another. The bifurcated arrangement may include a bridge or link between the forefoot cushion and the heel cushion, which may be provided by one or more of the plurality of plates. In some embodiments, the first plate is coupled to the forefoot cushion and the heel cushion and serves as a bridge or link between the forefoot cushion and the heel cushion. In some embodiments, the second plate is coupled to the forefoot cushion and the heel cushion and serves as an auxiliary bridge or link between the forefoot cushion and the heel cushion.

In some embodiments, the first plate, the second plate, and the third plate each connect or link the forefoot cushion to the heel cushion. A gap may be formed between a posterior end of the forefoot cushion and an anterior end of the heel cushion. The gap may extend uninterrupted from a lateral side to a medial side of the sole structure. In some embodiments, the gap is exposed on the lateral side or the medial side of the sole structure. In some embodiments, the gap is at least partially defined by a portion of the first plate, a portion of the second plate, a portion of the third plate, or some combination thereof. In some embodiments, the gap is positioned entirely in the midfoot region. In some embodiments, the gap extends into the forefoot region or the heel region. Additionally, the gap may provide a channel or pathway through which airflow is permitted, which can reduce the impact of drag forces on the sole structure during use.

The bifurcated arrangement may afford the sole structure various advantages, such as, e.g., weight savings, improved aerodynamic characteristics, and a performance differential between the decoupled cushions or sections of the sole structure. For example, the first plate may be formed of a material having a high strength-to-weight ratio and may serve as a bridge or connection between the separated forefoot and heel cushions, such that the sole structure can provide similar cushioning and support properties as a comparable sole structure but with less material and, thus, less mass. Further, the heel cushion may be formed of a different material than the forefoot cushion, which can allow the heel cushion to have different properties than the forefoot cushion. For instance, the heel cushion and forefoot cushion may differ from one another in stiffness, abrasion resistance, electrical resistance, texture, or other properties, which acts as a performance differential that can be selected or customized to suit a particular user.

Figure 2:
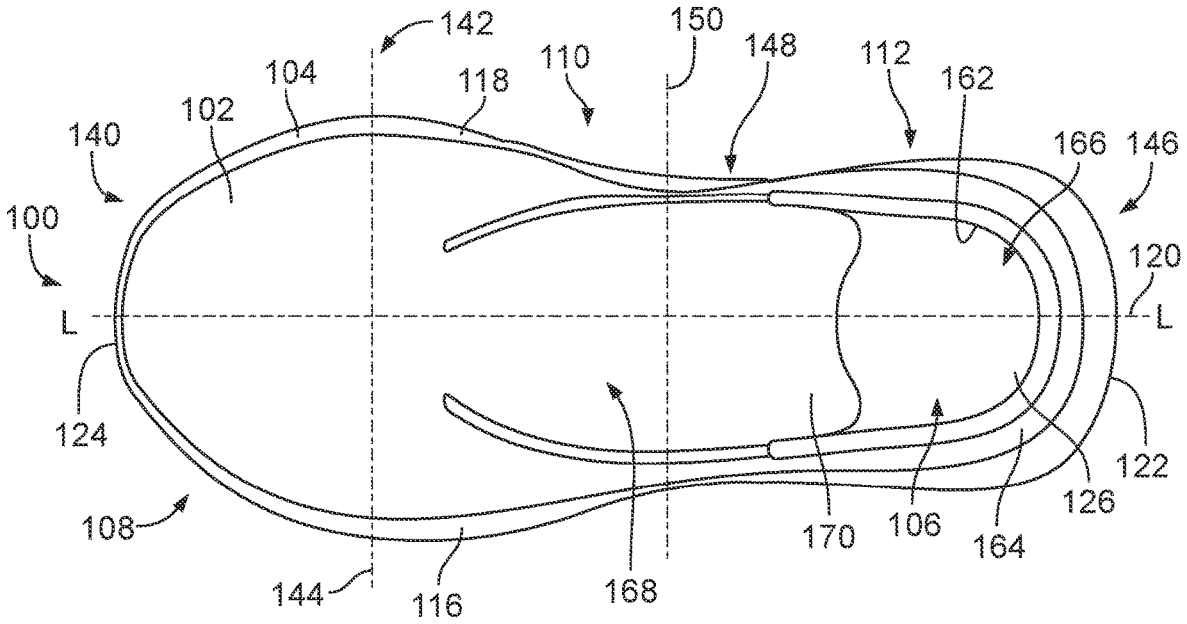
FIG. 2 is a top view of the article of footwear of FIG. 1.
Figure 3:
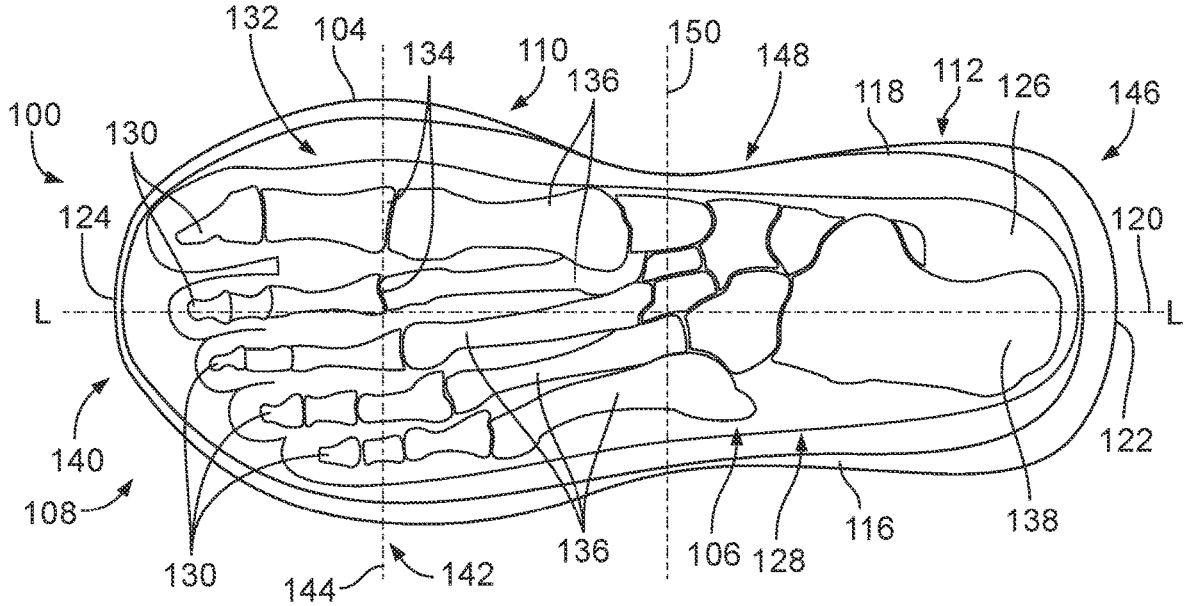
FIG. 3 is a top plan view of the article of footwear of FIG. 1, with an upper removed and a user's skeletal foot structure overlaid thereon.

FIGS. 1-3 depict an exemplary embodiment of an article of footwear 100 including an upper 102 and a sole structure 104. The upper 102 is attached to the sole structure 104 and together define an interior cavity 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

While only a single shoe 100 is depicted, i.e., a shoe that is worn on a left foot of a user (see FIGS. 2 and 3), it should be appreciated that the concepts disclosed herein are applicable to a pair of shoes (not shown), which includes a left shoe and a right shoe that may be sized and shaped to receive a left foot and a right foot of a user, respectively. For ease of disclosure, however, a single shoe will be referenced to describe aspects of the disclosure, but the disclosure below with reference to the article of footwear 100 is applicable to both a left shoe and a right shoe. However, in some aspects there may be differences between a left shoe and a right shoe other than the left/right configuration. Further, in some aspects, a left shoe may include one or more additional elements that a right shoe does not include, or vice versa.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

In some aspects, various layers of the upper 102 are heat pressed together so as to bond the various layers of the upper 102. For example, layers that comprise the upper 102 are heat pressed together all at once and at a single temperature. The upper 102 can be further attached to a strobel board by strobel stitching (not shown). During manufacturing of the upper 102, locating pins (not shown) can be used to align with various holes (not shown) within the upper 102. In some aspects, different layers of the upper 102 are waterproof or semi-waterproof, and include a plurality of layers of mesh or other materials. The materials that comprise the upper 102 include an inner mesh layer, a thermoplastic polyurethane (TPU) film, and/or an outer mesh layer. In some aspects, a TPU skin is applied along the other surface of the upper.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Figure 4:
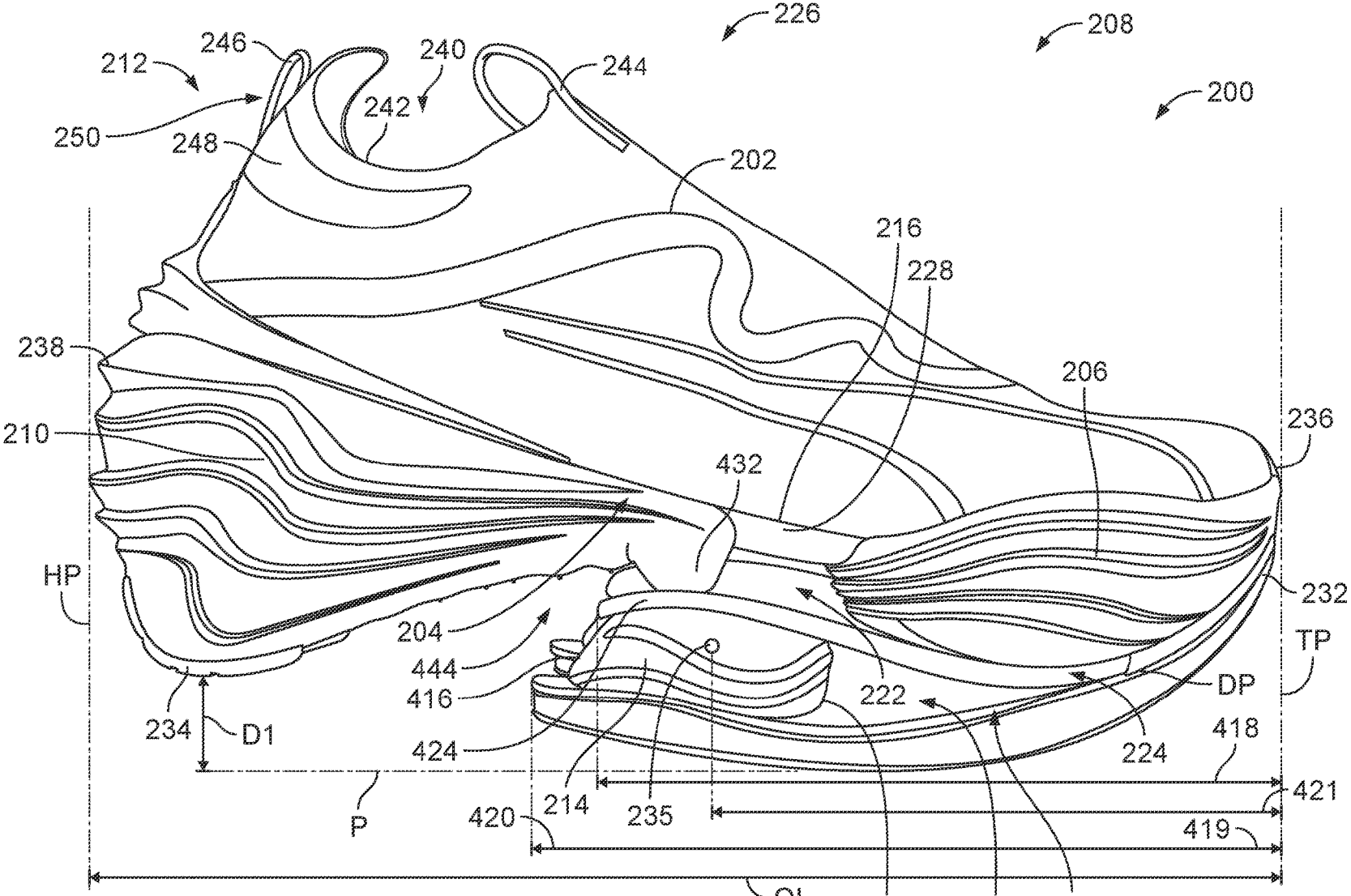
FIG. 4 is a perspective view of a top and lateral side of an article of footwear configured as a right shoe that includes an upper and a sole structure, according to another embodiment of the disclosure.

Referring to FIG. 4, another embodiment of an article of footwear 200 is depicted with an upper 202 and a sole structure 204 that includes a forefoot cushion 206 that is disposed in a forefoot region 208, a heel cushion 210 that is disposed in a heel region 212, a lateral cushion pod 214 that is disposed adjacent a lateral side 216, and a medial cushion pod 218 (see FIG. 5) that is disposed adjacent a medial side 220. Together, the forefoot cushion 206 and the heel cushion 210 are spaced apart in the longitudinal direction (i.e., toe-to-heel) by an upper gap or an intermediate gap 222 to provide a bifurcated midsole structure 224. Put another way, the intermediate gap 222 is formed in the midfoot region 226 between the heel cushion 210 and the forefoot cushion 206, such that the heel cushion 210 and the forefoot cushion 206 are linked or connected by a bridge portion 228 that extends across the intermediate gap 222. The sole structure 204 includes a plurality of plates 230 that are arranged in a multi-plate system to provide cushioning, stability, propulsion, reduced weight, and other performance advantages, which will be further described in detail herein. The sole structure 204 further includes a forward outsole portion 232 coupled to the plurality of plates 230 and a rearward outsole portion 234 that is coupled to the heel cushion 210. In the illustrated embodiment, when the article of footwear 200 is unworn, i.e., no foot is inserted, and rested on a planar surface P, the forward outsole portion 232 contacts the planar surface P while the rearward outsole portion 234 is elevated a distance D1 above the planar surface P. This is, in part, due to a center of mass (CM) point 235 of the article of footwear 200 being disposed toeward, i.e., closer to a toe end 236, of a midplane MP (see FIG. 7) that bisects the article of footwear 200 between the toe end 236 and a heel end 238. The midplane MP extends perpendicular to a longitudinal axis LA (see FIG. 6) and intersects the sole structure 204 in the midfoot region 226. Accordingly, the CM point 235 is located between the midplane MP (see FIG. 7) and the toe end 236, such that footwear 200 is weighted toward the toe end 236 to enhance or emphasize aspects of the plurality of plates 230 and bifurcated midsole structure 224, as will be further described herein. By locating the CM point 235 toeward of the midplane MP, the article of footwear 200 is toe-weighted and, thus, pre-loaded to provide efficient impact response with the ground (e.g., planar surface P) when jogging or running. In other words, the mass distribution of the article of footwear 200 is intentionally imbalanced and programmed to promote efficient running and impact. For instance, a user running on the ball of the foot or MTP is afforded leverage that assists with propulsion. Further, locating the CM point 235 toewardly of the midplane MP also promotes efficient travel of the user's foot through a gait cycle, since the forefoot region has a greater proportion of mass than the heel region and is weighted more heavily, which exerts a greater downward force on the forefoot of the user as compared to a downward force on the heel of the user. As a result, the downward force on the forefoot assists with positioning or angling the user's foot for subsequent impact with the ground surface to further aid with leverage and propulsion. In this way, the sole structure reduces wasted energy and effort involved in counteracting a conventional balanced or heel-weighted shoe.

Still referring to FIGS. 4, the upper 202 of the article of footwear 200 includes an ankle opening 240 that is at least partially located in the heel region 212 of the article of footwear 200, that provides access to the interior cavity (not shown) and through which a foot may be inserted and removed. In the illustrated embodiment, the ankle opening 240 is formed by an ankle cuff 242 that is configured to elastically expand and contract during entry and exit of a user's foot. Accordingly, the ankle cuff 242 is biased to a contracted position, as illustrated in FIG. 4, and is configured to be expanded by the user pulling on at least one of a first strap 244 and a second strap 246 when inserting the foot through the ankle opening 240. Together, the ankle cuff 242, the first strap 244, and the second strap 246 form a closure system 250 of the article of footwear 200. In the illustrated embodiments, the first strap 244 is formed as a loop with opposing ends attached to a portion of the ankle cuff 242 of the upper 202 toewardly, i.e., closer to the toe end 236, of the ankle opening 240. The first strap 244 extends over the ankle opening 240 to be intuitively and easily pulled by the user before inserting the foot through the ankle opening 240. The second strap 246 is formed as a loop with opposing ends attached to the upper 202 rearwardly, i.e., closer to the heel end 238, of the ankle opening 240. The second strap 246 is arranged at the heel end 238 of the upper 202 to be opposite the first strap 244 relative to the ankle opening 240, such that the user can intuitively and easily pull the first strap 244 and the second strap 246 away from one another to cause the ankle cuff 242 to expand, thereby enlarging the ankle opening 240 to receive the user's foot. Once the user's foot is inserted through the ankle opening 240, the first strap 244 and second strap 246 can be released to allow the ankle cuff 242 to contract and tighten around the user's ankle, thereby securing the foot within the footwear 200. Further, the upper 202 is formed of a material that fits tightly or snugly around a user's foot, thereby distributing compressive forces along the entire foot to secure the foot within the footwear 200.

In some embodiments, the closure system 250 includes a lace (not shown) that extends through a plurality of eyelets (not shown). In some aspects, the closure system 250 includes bands, strips, segments, or regions of elastic material that is biased to compress and conform to a user' inserted foot. The closure system 250 may allow a user to modify dimensions of the upper 202, e.g., to tighten or loosen portions of the upper 202, around a foot as desired by the wearer. In some aspects, the closure system 250 also includes a band (not shown) that runs along a center of the upper 202 and includes one or more loops through which the lace is guided. In other aspects, the closure system 250 is a hook-and-loop fastening system, such as Velcro®. For example, in some aspects, the closure system 250 includes one or more hook-and-loop fastening straps. In further aspects, the closure system 250 is another laceless fastening system known in the art. In some aspects, the closure system 250 includes a rotary closure device or an automatic lacing system, such as the lacing systems described in U.S. patent application Ser. No. 15/780,368, filed on May 31, 2018, and U.S. patent application Ser. No. 16/392,470, filed on Apr. 23, 2019, each of which is hereby incorporated by reference in its entirety.

With reference to FIG. 4, the article of footwear 200 includes the ankle pad 248 in the heel region 212 which extends along the lateral side 216 of the upper 202 to follow the curvature of the ankle cuff 242. The ankle pad 248 of the illustrated embodiment is curved and widens or thickens moving toward the heel end 238. In some embodiments, the ankle pad 248 wraps or extends around the heel end 238 of the upper 202 to the medial side 220 to be substantially symmetrical in size and shape across the lateral side 216 and the medial side 220. The ankle pad 248 is configured to provide cushion and support to a user's ankle by thickening the portion of the upper 202 adjacent the ankle cuff 242 to accommodate ranges of anatomical sizes of ankles. In other words, the ankle pad 248 provides a cushion for both comfort and adjustment to improve the fit of the shoe for a range of sizes and types of users.

Figure 5:
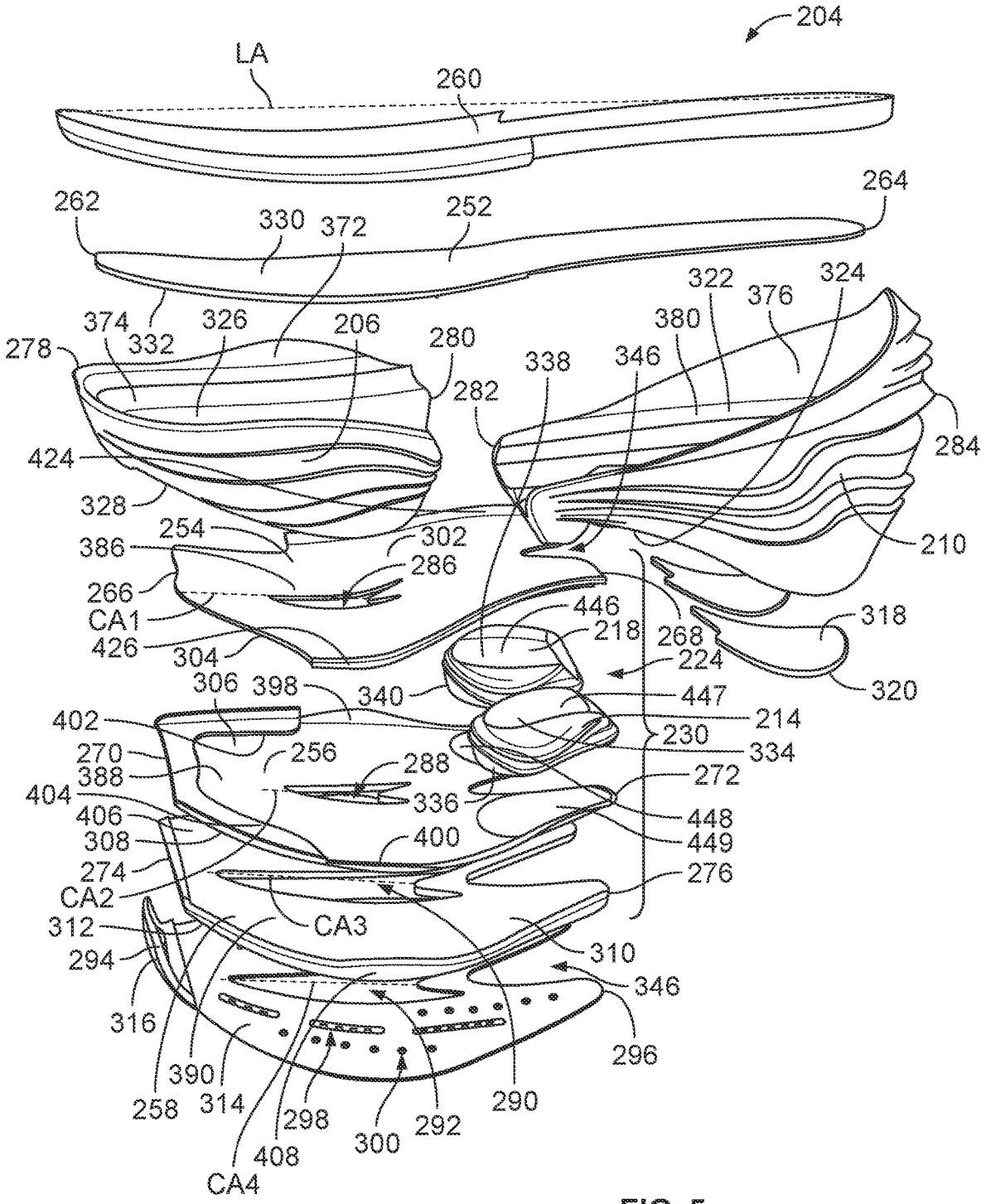
FIG. 5 is an exploded view of the sole structure of FIG. 4.

Turning to FIG. 5, an exploded view of the sole structure 204 of the footwear 200 depicts the plurality of plates 230 and the bifurcated midsole structure 224 in relation to one another. In the illustrated embodiment, the plurality of plates 230 includes a shank 252, an upper plate 254, an intermediate plate 256, and a lower plate 258. It will be appreciated that the shank 252 may be referenced herein as a top plate and any of the upper plate 254, the intermediate plate 256, or the lower plate 258 may be referenced herein as a middle plate or a bottom plate. It will also be appreciated that any of the plurality of plates 230 may be referenced herein as a first plate, a second plate, a third plate, or a fourth plate. A liner or insole 260 is configured to rest atop and extend along the shank 252. The lateral cushion pod 214 and the medial cushion pod 218 are configured to be disposed among the plurality of plates 230. In the illustrated embodiment, the lateral cushion pod 214 and the medial cushion pod 218 are disposed between the shank 252 and the lower plate 258. As illustrated in FIG. 5, each of the lateral cushion pod 214 and the medial cushion pod 218 are in contact with and arranged between the upper plate 254 and the intermediate plate 256.

The shank 252 includes a shank anterior end 262 that is opposite a shank posterior end 264. The upper plate 254 includes an upper anterior end 266 that is opposite an upper posterior end 268, the intermediate plate 256 includes an intermediate anterior end 270 that is opposite an intermediate posterior end 272, and the lower plate 258 includes a lower anterior end 274 that is opposite a lower posterior end 276. Any of the anterior ends 262, 266, 270, 274 may be referenced herein as a first anterior end, a second anterior end, a third anterior end, or a fourth anterior end. Similarly, any of the posterior ends 264, 268, 272, 276 may be referenced herein as a first posterior end, a second posterior end, a third posterior end, or a fourth posterior end. The forefoot cushion 206 includes a forefoot cushion anterior end 278 and a forefoot cushion posterior end 280, while the heel cushion 210 includes a heel cushion anterior end 282 and a heel cushion posterior end 284. As illustrated, the shank 252 extends continuously from the shank posterior end 264 to the shank anterior end 262. Alternatively, in some embodiments, the shank 252 may be discontinuous such that the shank 252 includes interconnected segments (e.g., seams, hinges, or interlocking structures), decoupled or discrete portions, or apertures or cutouts between the shank posterior end 264 to the shank anterior end 262. The upper plate 254 includes an upper cutout 286 that is positioned between the upper anterior end 266 and the upper posterior end 268, the intermediate plate 256 includes an intermediate cutout 288 that is positioned between the intermediate anterior end 270 and the intermediate posterior end 272, and the lower plate 258 includes a lower cutout 290 that is positioned between the lower anterior end 274 and the lower posterior end 276.

With continued reference to FIG. 5, the forward outsole portion 232 includes an outsole cutout 292 between a forward outsole anterior end 294 and a forward outsole posterior end 296. Furthermore, the forward outsole portion 232 may include a plurality of slots 298 and a plurality of apertures 300 that are disposed around the outsole cutout 292. In some embodiments, the size of the cutouts 286, 288, 290, 292 can be different from each other. For example, the size of the cutouts can change gradually along the thickness of the plurality of plates 230. In some embodiments, the size of the cutouts 286, 288, 290, 292 can be identical to each other. In some embodiments, the cutouts 286, 288, 290, 292 are axially aligned with one other to be collinear or coaxial along a vertical direction that is perpendicular to the longitudinal axis LA. In some embodiments, the cutouts 286, 288, 290, 292 are stacked to form a pyramid like structure, such that edges of cutouts form an incrementally expanding or narrowing profile or periphery. In some embodiments, the cutouts 286, 288, 290, 292 each define a geometric center (not shown) that is aligned with one another to be collinear or coaxial in the vertical direction. In some embodiments, the geometric center of the cutouts 286, 288, 290, 292 can be unaligned (e.g., offset) from one another. In some embodiments, at least one of the cutouts 286, 288, 290, 292 is identical in size and shape to at least one other of the cutouts 286, 288, 290, 292.

The upper plate 254 of FIG. 5 includes an upper plate top surface 302 that is opposite an upper bottom surface 304, intermediate plate 256 includes an intermediate top surface 306 opposite of an intermediate bottom surface 308, and the lower plate 258 includes a lower plate top surface 310 that is opposite a lower bottom surface 312. The forward outsole portion 232 includes a forward outsole top surface 314 that is opposite a forward outsole bottom surface 316 and the rearward outsole portion 234 includes a rearward outsole top surface 318 that is opposite a rearward outsole bottom surface 320. The forward outsole bottom surface 316 and the rearward outsole bottom surface 320 are configured to engage the ground. The heel cushion 210 includes a heel cushion top surface 322 that is opposite a heel cushion bottom surface 324, and the forefoot cushion includes a forefoot top surface 326 that is opposite a forefoot bottom surface 328. The shank includes a shank top surface 330 that is opposite a shank bottom surface 332. The lateral cushion pod 214 includes a lateral cushion top surface 334 that is opposite a lateral cushion bottom surface 336, and the medial cushion pod 218 includes a medial cushion top surface 338 that is opposite a medial cushion bottom surface 340.

Figure 6:
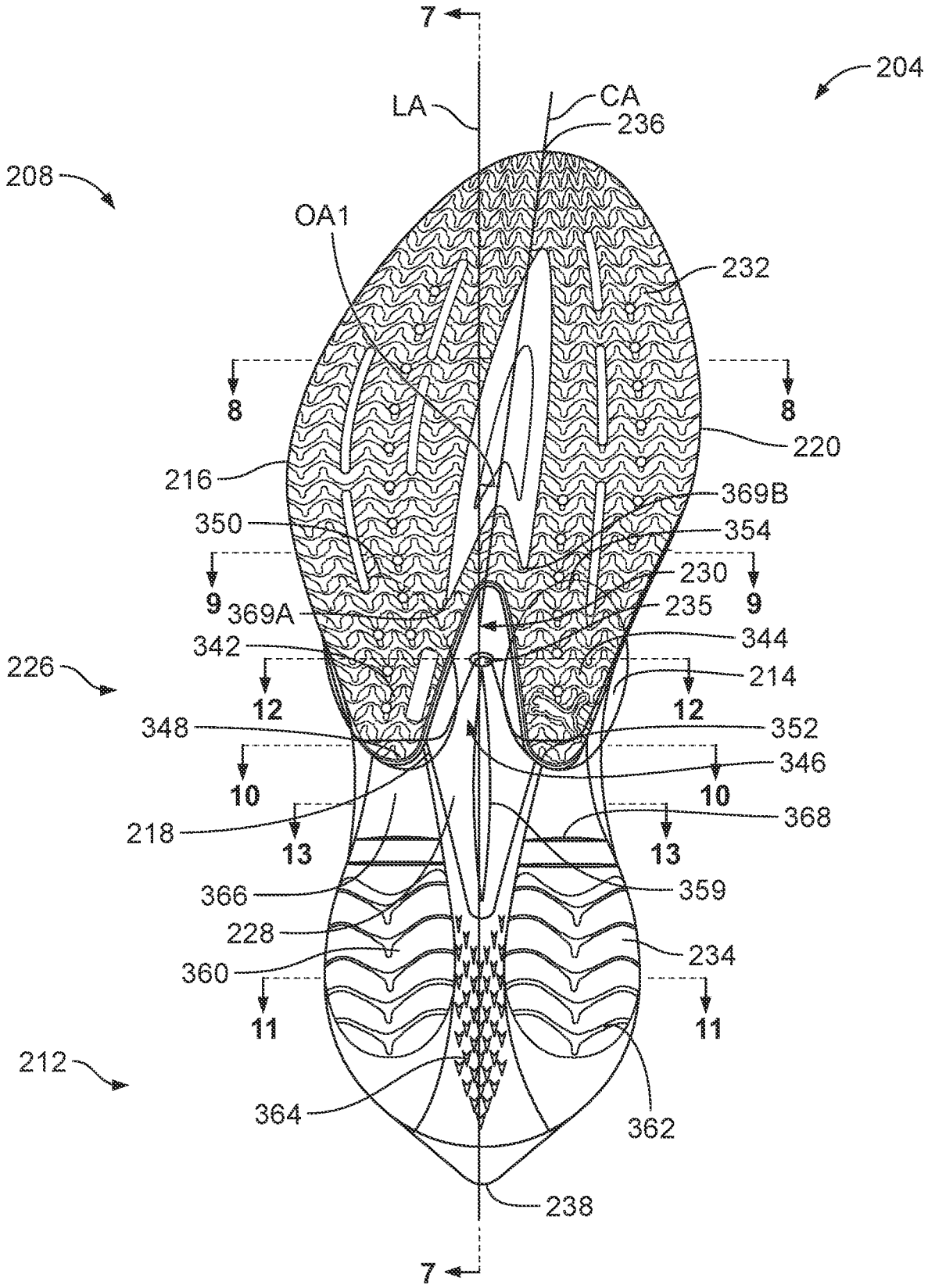
FIG. 6 is a bottom plan view of the article of footwear of FIG. 4.
Figure 7:
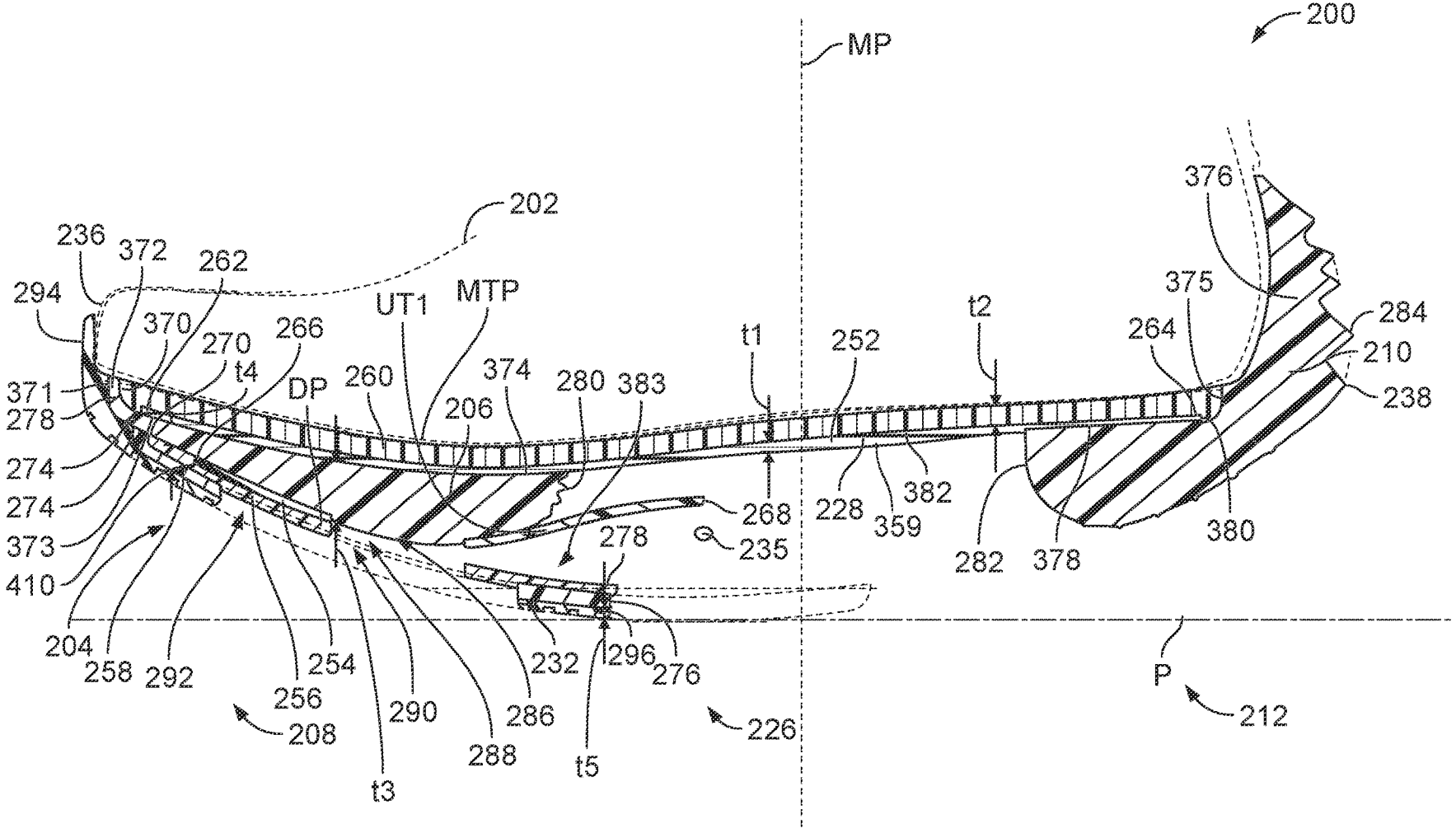
FIG. 7 is a cross-sectional view of the article of footwear along 7-7 of FIG. 6.
Figure 8:
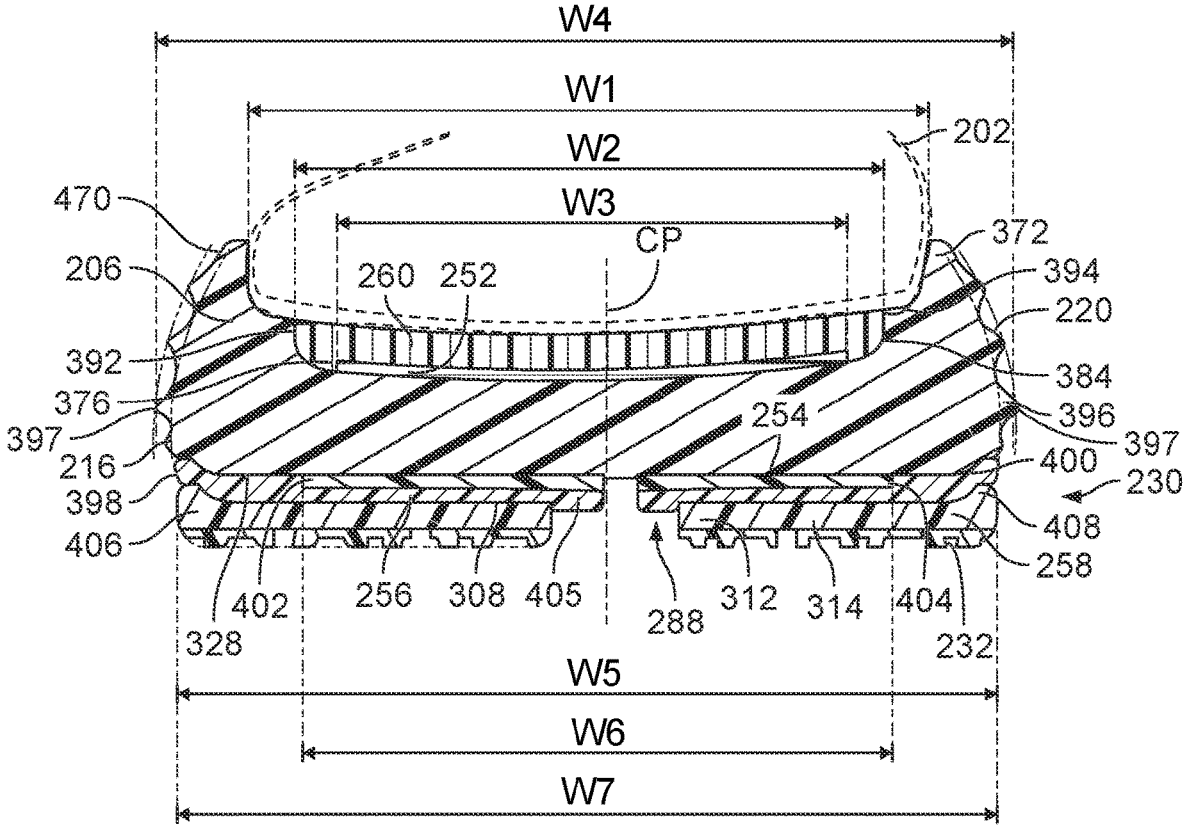
FIG. 8 is a cross-sectional view of the article of footwear along 8-8 of FIG. 6.
Figure 9:
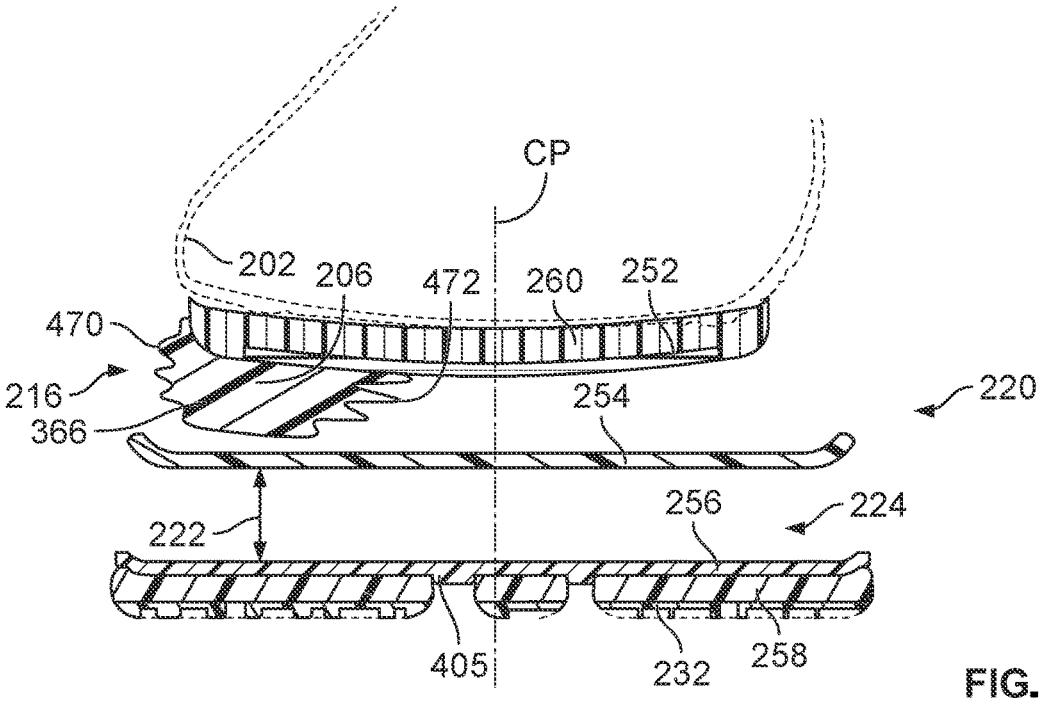
FIG. 9 is a cross-sectional view of the article of footwear along 9-9 of FIG. 6.
Figure 10:
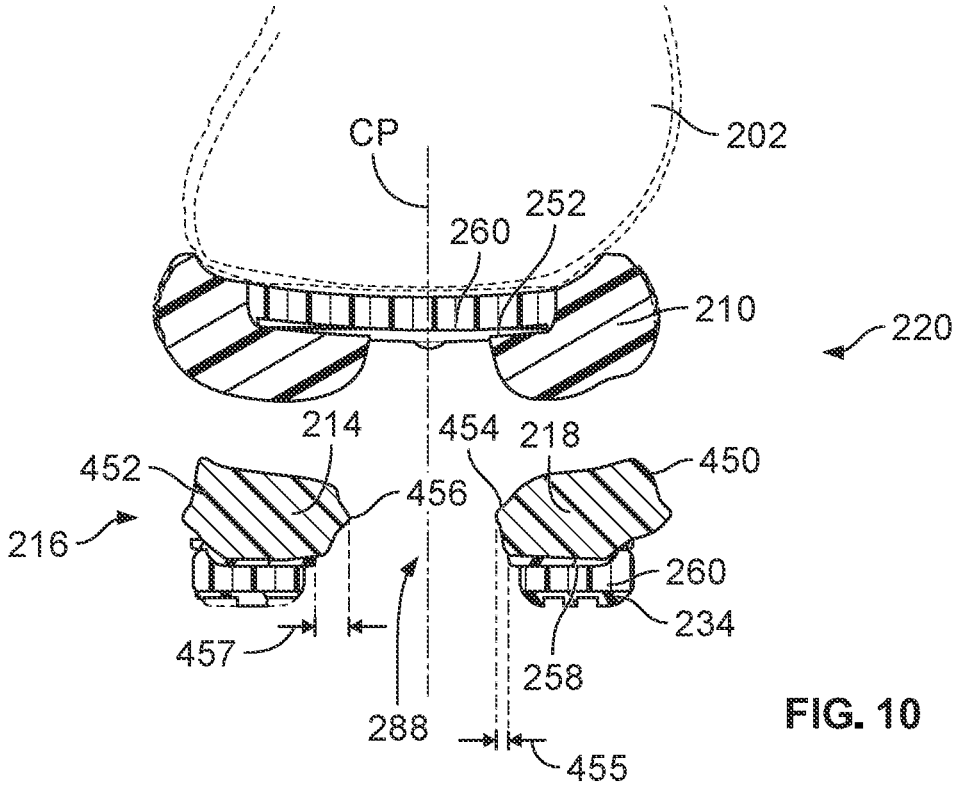
FIG. 10 is a cross-sectional view of the article of footwear along 10-10 of FIG. 6.
Figure 11:
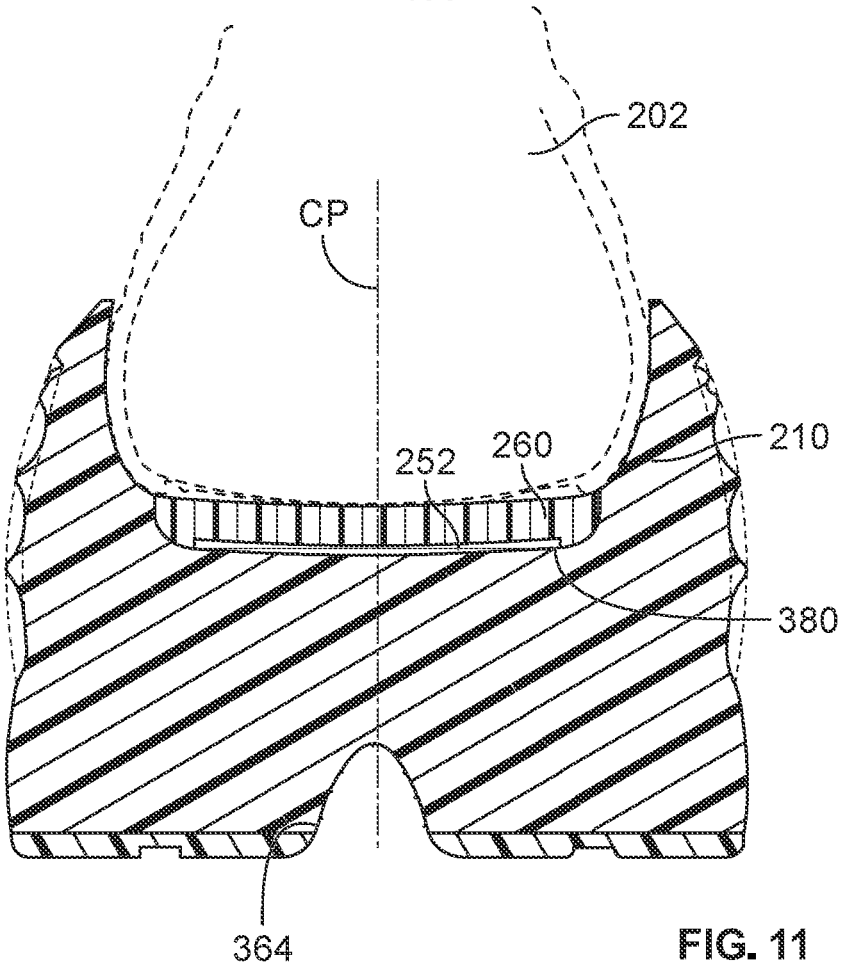
FIG. 11 is a cross-sectional view of the article of footwear along 11-11 of FIG. 6.

Referring to FIG. 6, illustrates a bottom view of the sole structure 204 and shows various cross-sections are taken along a length of the footwear 200 between the toe end 236 and the heel end 238. A first cross-section (7-7) is taken along a central plane CP defined along the longitudinal axis LA of the footwear (see FIG. 8) and is illustrated in FIG. 7, a second cross-section (8-8) is taken along a forefoot region 208 and is illustrated in FIG. 8, a third cross-section (9-9) is taken between the forefoot region 208 and the midfoot region 226 and is illustrated in FIG. 9, a fourth cross-section (10-10) is taken along the midfoot region 226 and is illustrated in FIG. 10, and a fifth cross-section (11-11) is taken along the heel region 212 and is illustrated in FIG. 11.

FIG. 6 depicts the forward outsole portion 232 extending from the toe end 236 in the forefoot region 208 to the midfoot region 226 and the rearward outsole portion 234 that is disposed in the heel region 212 extending from the heel end 238 toward the medial and lateral cushion pods 214, 218. The forward outsole portion 232 and the rearward outsole portion 234 are separate and distinct portions. In some embodiments, the forward outsole portion 232 and the rearward outsole portion 234 may include groove patterns to provide additional traction with a ground surface or terrain, which may be represented as, e.g., the planar surface P in FIG. 4.

Still referring to FIG. 6, the intermediate plate 256, the lower plate 258 and the forward outsole portion 232 are connected to form a lateral leg 342 and a medial leg 344, between which is an expansion zone 346. For instance, referring back to FIG. 5, the lateral leg 342 and the medial leg 344 are formed at the intermediate posterior end 272 of the intermediate plate 256, the lower posterior end 276 of the lower plate 258, and the forward outsole posterior end 296 of the forward outsole portion 232. Referring again to FIG. 6, in the illustrated example, the lateral leg 342 is disposed directly adjacent to the lateral cushion pod 214 and the medial leg 344 is disposed directly adjacent to the medial cushion pod 218. The expansion zone 346 is disposed between the lateral leg 342 and the medial leg 344 and allows the cushion pods 214, 218 to expand when the outsole (e.g., ground engaging surface) strikes or is compressed under loading against the ground or terrain, e.g., surface P. In some embodiments, the cushion pods 214, 218 that are disposed directly above the lateral and medial legs 342, 344 are spaced apart across the expansion zone 346. In some embodiments, the expansion zone 346 is bounded by the bridge portion 228. The lateral leg 342 includes a first distal end 348 and a first proximal end 350 that is opposite the first distal end 348. The first distal end 348 of the lateral leg 342 is disposed opposite the toe end 236 position along the lateral side 216 of the forward outsole portion 232. Similarly, the medial leg 344 includes a second distal end 352 and a second proximal end 354 that is disposed opposite the second distal end 352. The second distal end 352 of the medial leg 344 is disposed opposite the toe end 236 along the medial side 220 of the forward outsole portion 232. The first distal end, 348, the second distal end 352, and the expansion zone 346 disposed between the first and second proximal ends 350, 354 forms at least two inflexion points (e.g., a point where change in curvature occurs).

In some examples, the size of the expansion zone 346 may be different. For instance, the size of the expansion zone 346 gets smaller along the plurality of plates 230, as the plurality of plates 230 is closer to the shank 252. In some embodiments, the shank 252 may include a rib 359 that is disposed along the shank bottom surface 332 (e.g., underside of the upper plate). The rib 359 extends between the forefoot and the heel cushions 206, 210 and the rib 359 provides additional thickness to the shank 252 along the longitudinal axis LA for stability and/or propulsion. Referring back to FIG. 5, in the illustrated example, the size of the expansion zone 346 is greatest at a location that is adjacent and coplanar with the forward outsole portion 232 (e.g., furthest from the shank) and is smallest at a location that is adjacent and coplanar with the upper plate 254 (e.g., closest to the shank). Alternatively, in some examples, size of the expansion zone 346 may be greater toward the planar surface.

Still referring to FIG. 6, the rearward outsole portion 234 is provided with a lateral heel outsole section 360 and a medial heel outsole section 362 that are separate and distinct portions, which are arranged on opposing sides of the longitudinal axis LA. The lateral heel outsole section 360 and the medial heel outsole section 362 of the illustrated embodiment is separated by a recessed surface 364 that extends along the longitudinal axis LA of the heel cushion 210. In some embodiments, the recessed surface 364 may include grooves, barbs, cutouts, or a combination thereof. In some embodiments, the recessed surface 364 may be disposed between a channel. In some embodiments, the recessed surface 364 may include undulations or grooves. The recessed surface 364 is defined between a lateral arm 366 that extends along the lateral side 216 of the heel cushion 210, and a medial arm 368 that extends along the medial side 220 of the heel cushion 210. In the illustrated example, the lateral heel outsole section 360 is disposed directly beneath the lateral arm 366 of the heel cushion 210 and the medial heel outsole section 362 is disposed directly beneath the medial arm 368 of the heel cushion 210. The medial arm 368 and the lateral arm 366 of the heel cushion 210 forms part of the bridge portion 228 that connects to the medial leg 344 and the lateral leg 342 respectively. In the illustrated example, the bridge portion 228 can extend obliquely relative to the longitudinal axis LA. In some examples, the shape of the bridge portion 228 can be perpendicular to the longitudinal axis LA.

In some examples, the outsole cutout 292, the lower cutout 290, the intermediate cutout 288, and the upper cutout 286 can be stratified along a sole-to-upper direction that is perpendicular to the planar surface P (See FIG. 4). With reference to FIGS. 5 and 6, the cutouts 286, 288, 290, 292 can define a cutout axis CA that is offset from the longitudinal axis LA by an offset angle OA1. In particular, the cutout axis CA extends from the toe end 236 toward the longitudinal axis LA between a lateral apex point 369A and a medial apex point 369B such that the lateral apex point 369A and the medial apex point 369B are equidistant from the cutout axis CA. Referring back to FIG. 5, the upper plate 254 includes a first cutout axis CA1, the intermediate plate 256 includes a second cutout axis CA2, the lower plate 258 includes a third cutout axis CA3, and the forward outsole portion 234 includes a fourth cutout axis CA4. The first, second, third and fourth cutout axis CA1, CA2, CA3, CA4 are all aligned with each other at a predetermined offset angle OA1 relative to the longitudinal axis LA. Accordingly, as illustrated in FIG. 6, the cutout axis CA is offset from the longitudinal axis by the offset angle OA1. However, in some embodiments, the cutout axes CA can be offset relative to each other such that the cutout axes are not aligned with each other. In the illustrated example, the shape of the cutouts 286, 288, 290, 292 can be an arrowhead shape. In some examples, the shape of the cutouts 286, 288, 290, 292 can be a polygon, ovular, circular, an irregular shape, or the like.

FIG. 7 illustrates a cross-sectional view of the footwear 200 along the longitudinal direction (e.g., 7-7). The toe end 236 of the sole structure 204 is arranged with the forward outsole anterior end 294 extending as a cover partially across the upper 202, the forefoot cushion anterior end 278, and the lower anterior end 274. Beneath the upper 202, the insole 260 extends along the shank 252 and has an insole anterior end 370 that is disposed between the shank anterior end 262 and disposed at a tip 371 of a forefoot cushion anterior lip 372 of the forefoot cushion anterior end 278 of the forefoot cushion 206. In some examples, the forefoot cushion anterior lip 372 described herein can extend from the forefoot cushion anterior end 278 to the forefoot cushion posterior end 280, forming a forefoot periphery 373 of a forefoot retaining region or a forefoot recess 374 (see FIG. 5). Similarly, an insole posterior end 375 is disposed between the shank posterior end 264 and a heel cushion posterior lip 376 that is disposed at the heel cushion posterior end 284 of the heel cushion 210. In some examples, the heel cushion posterior lip 376 described herein can extend from the heel cushion posterior end 284 to the heel cushion anterior end 282, forming a heel periphery 378 of a heel retaining region or a heel recess 380 (see FIG. 5). The forefoot recess 374 and the heel recess 380 can be configured to retain a portion of a neighboring structure (e.g., plates, cushions, and/or pods).

With continued reference to FIG. 7, the shank 252 extends continuously from the shank anterior end 262 in the forefoot region 208, which is adjacent the toe end 236, through the midfoot region 226, to the shank posterior end 264 in the heel region 212, which is adjacent the heel end 238. The shank 252 includes a shank bridge portion 382 that spans between the forefoot cushion 206 and the heel cushion 210. In the illustrated embodiment, the rib 359 extends along at least a portion of the shank bridge portion 382 and is exposed through the intermediate gap 222 from a bottom view of the sole structure 204, as illustrated in FIG. 6. The shank anterior end 262 of the shank 252 sits within the forefoot recess 374 that is formed in the forefoot cushion 206 and the shank posterior end 264 of the shank sits within the heel recess 380 that is formed in the heel cushion 210. In some examples, the heel recess 380 and the forefoot recess 374 together form a midsole bed 384 (see FIG. 8) in which the insole 260 and the shank 252 are disposed.

Still referring to FIG. 7, the placement of the plurality of plates 230 to form a sole structure 204 is shown. In the illustrated example, three plates (e.g., upper, intermediate, and lower) are shown to form a divergent configuration 383 of the sole structure 204, which may be described as a structure having forked or divergent plates or members. In some embodiments, a first plate (e.g., shank 252) of the plurality of plates 230 may have a first anterior end (e.g., shank anterior end 262) that is disposed adjacent to the toe end 236 of the sole structure 204 and a first posterior end (e.g., shank posterior end 264) that is disposed within the heel region 212 of the sole structure 204. In other words, the first plate extends from the forefoot region 208 to the heel region 212. A second plate (e.g., upper plate 254) of the plurality of plates 230 may have a second anterior end (e.g., upper anterior end 266) that is disposed adjacent to the toe end 236 and a second posterior end (e.g., upper posterior end 268) that is disposed in the midfoot region 226 of the sole structure 204. In some examples, a first cushion (e.g., forefoot cushion 206) is disposed between the first and second plate to support the shank anterior end 262 in the forefoot region 208. Additionally, the heel cushion 210 is disposed opposite of the forefoot cushion 206 to support the shank posterior end 264. As described above, the bridge portion 228 is formed above the intermediate gap 222 to connect the heel cushion 210 to the forefoot cushion 206. A third plate (e.g., intermediate plate 256) of the plurality of plates 230 may have a third anterior end (e.g., intermediate anterior end 270) that is disposed adjacent the toe end 236 and a third posterior end (e.g., intermediate posterior end 272) that is disposed in the midfoot region 226. In some embodiments, the second and third plates are coplanar in the forefoot region 208, in that the second and third plate contact one another to define a contact surface area in two directions, e.g., a medial-lateral direction between the medial side 220 and lateral side 216 and a longitudinal direction along the longitudinal axis LA, and extend in parallel with one another along at least one of such directions, e.g., the longitudinal direction. The second plate and the third plate may be coplanar until the second plate diverges from the third plate to form the divergent configuration 383 at the diverging point DP in the forefoot region 208. A fourth plate (e.g., lower plate 258) may be coupled to the forward outsole portion 232, and the fourth plate can be sandwiched between the third plate and the outsole in the forefoot region 208.

Referring back to FIG. 5, the upper plate 254 may include an upper recess 386 that is at least partially bounded by a lateral upper lip 424 and a medial upper lip 426, the intermediate plate 256 may include an intermediate recess 388 that is at least partially bounded by a lateral intermediate lip 398 and a medial intermediate lip 400, and the lower plate 258 may include a lower recess 390 that is at least partially bounded by a lateral intermediate lip 398 and a medial intermediate lip 400. Accordingly, the recesses 386, 388, 390 can be configured to receive a portion of the neighboring components. For instance, along a forefoot region 208, the upper plate 254 is nested within the intermediate recess 388, and the intermediate plate 256 is nested within the lower recess 390. Additionally, the forefoot cushion 206 can be nested within the upper recess 386. The nested configuration of the plates 254, 256, 258 within the recesses 386, 388, 390 provide various benefits. For example, the recesses 386, 388, 390 allows the plates to be contained in multiple directions providing a lock and key relationship. Furthermore, the recesses 386, 388, 390 may provide reduction of weight via reduction of material along the given cross-section of the article of footwear 200.

Referring now to FIG. 8, the nested plurality of plates 230 are arranged within and along the forefoot region 208. As described above, the forefoot recess 374 retains the insole 260 and the shank 252. In the illustrated example, a width W1 between the lateral side 216 of the upper 202 and the medial side 220 of the upper 202 can be greater than a width W2 of the insole 260. In some examples, the width W1 of the upper 202 may vary (e.g., get narrower toward the ankle opening 240) as the upper 202 extends away from the insole 260 and the sole structure 204. Furthermore, the width W1 of the upper 202 can be greater than both the width W2 of the insole 260 and a width W3 of the shank 252. The width W2 of the insole 260 can be greater than the width W3 of the shank 252. The forefoot cushion anterior lip 372 of the forefoot cushion 206 retains the shank 252 between a lateral forefoot recess wall 392 and a medial forefoot recess wall 394 disposed within the forefoot recess 374. Additionally, the forefoot cushion anterior lip 372 of the forefoot cushion 206 retains the insole anterior end 370. In some examples, the width W2 of the insole 260 is equivalent to the distance between the lateral forefoot recess wall 392 and the medial forefoot recess wall 394. A width W4 of the forefoot cushion 206 increases gradually from the forefoot cushion anterior lip 372 toward the forefoot bottom surface 328. In the illustrated example, the forefoot cushion 206 includes plurality of ridges 396 formed along the lateral side 216 and the medial side 220 of the forefoot region 208.

With continued reference to FIG. 8, the intermediate plate 256 includes a lateral intermediate lip 398 and a medial intermediate lip 400 that is configured to retain the forefoot bottom surface 328 of the forefoot cushion 206. In the illustrated example, a bottommost ridge 397 of the plurality of ridges 396 of the forefoot cushion 206 is disposed directly adjacent to the lateral intermediate lip 398 and the medial intermediate lip 400. In some examples, the bottommost ridge 397 of the plurality of ridges 396 may be flush with the lateral intermediate lip 398 and the medial intermediate lip 400. The intermediate recess 388 includes a lateral intermediate recess wall 402 and a medial intermediate recess wall 404 that are configured to retain the upper plate 254. A width W5 defined between the intermediate lips 398, 400 is greater than a width W6 defined between the intermediate recess walls 402, 404. In some examples, the width of the intermediate recess walls 402, 404 may be identical to a width of the upper plate 254. The intermediate plate 256 further includes a rim 405 that protrudes beyond the lower bottom surface 312 of the intermediate plate 256 between the intermediate cutout 288. The lower plate 258 includes a lateral lower lip 406 and a medial lower lip 408 (See FIG.

10) that is configured to retain a portion the intermediate bottom surface 308. In the illustrated embodiment, the width W5 between the lateral intermediate lip 398 and the medial intermediate lip 400 is substantially similar to a width W7 defined by lateral lower lip 406 and the medial lower lip 408. The forward outsole top surface 314 of the forward outsole portion 232 is disposed directly adjacent to the lower bottom surface 312 of the lower plate 258. The widths W1, W2, W3, W4, W5, W6, W7 of the sole structure 204 may vary between the toe end 236 and the heel end 238 of the article of footwear 200.

Still referring to FIG. 8, the cutouts 286, 288, 290, 292 (e.g., upper cutout, intermediate cutout, lower cutout, outsole cutout) are located between the medial side 220 and the lateral side 216 of the footwear 200. In some embodiments, the cutouts 286, 288, 290, 292 are disposed partially along the longitudinal axis LA and intersected by the central plane CP that is defined along the longitudinal axis LA. In some embodiments, one or more of the cutouts 286, 288, 290, 292 can be disposed offset from the central plane CP of the longitudinal axis LA.

Referring now to FIG. 9, a cross-sectional view of the footwear 200 between the forefoot region 208 and the midfoot region 226 is shown. In some embodiments, the lateral arm 366 of the forefoot cushion 206 along the lateral side 216 extends a greater distance from the toe end 236 than a distance that the medial arm 368 of the forefoot cushion 206 extends from the toe end 236 along the medial side 220. Alternatively, in some embodiments, the lateral arm 366 of the forefoot cushion 206 along the lateral side 216 extends a shorter distance than a distance that the medial arm 368 of the forefoot cushion 206 extends along the medial side 220. In some embodiments, both the lateral arm 366 and the medial arm 368 of the forefoot cushion 206 may extend the same distance to be coextensive relative to the toe end 236. The upper plate 254 and the intermediate plate 256 are spaced apart by the intermediate gap 222 in order to form the divergent configuration 383. Referring back to FIGS. 5 and 7, the upper plate 254 curves upwardly toward the shank 252, while the intermediate plate 256 extends downwardly away from the upper plate 254. More specifically, the upper plate 254 curves concavely relative to the forefoot cushion 206 from the upper anterior end 266 to a transition point UT1 that is spaced toewardly from the upper posterior end 268, and the upper plate 254 further curves convexly relative to the forefoot cushion 206 and the heel cushion 210 from the transition point UT1 to the upper posterior end 268. The intermediate plate 256 curves concavely relative to the forefoot cushion 206 from the intermediate anterior end 270 to the intermediate posterior end 272, and the lower plate 258 curves concavely relative to the forefoot cushion 206 from the lower anterior end 274 to the lower posterior end 276. The upper plate 254, the intermediate plate 256, and the lower plate 258 have a relatively similar and/or constant radius of curvature extending from the toe end 236 to a divergent point DP at which the upper plate 254 begins to diverge from, e.g., curves along a different radius of curvature in comparison to, the intermediate plate 256 and the lower plate 258 moving in the heelward direction from the divergent point DP toward the upper posterior end 268 in the midfoot region 226. Put another way, the divergent point DP is a location where the upper plate 254 and the intermediate plate 256 begin to diverge or extend in opposite directions to form the divergent configuration 383. In some embodiments, the upper plate 254 may curve from an anterior-most point 410 toward the divergent point DP that is positioned toweard, e.g., closer to the toe end 236, of a metatarsophalangeal (MTP) point of the sole structure 204. In the illustrated embodiment, the transition point UT1 is positioned heelward, e.g., closer to the heel end 238, of the divergent point DP and the MTP Ipoint, although other configurations are contemplated.

FIG. 10 shows a gap disposed between the heel cushion 210 and the cushion pods 214, 218. Referring back to FIG. 4 and as described above, the upper plate 254 curves away from the intermediate plate 256 forming the bifurcating midsole structure 224. The cushion pods 214, 218 are disposed between the upper posterior end 268 and the intermediate posterior end 272. In some examples, along the lateral cushion top surface 334, the lateral cushion pod 214 engages with the upper plate 254 along the lateral side 216, and along the medial cushion top surface 338, the medial cushion pod 218 engages along the medial side 220 of the upper plate 254. Further, along the lateral cushion bottom surface 336, the lateral cushion pod 214 engages with the intermediate plate 256 along the lateral side 216, and along the medial cushion bottom surface 340, the medial cushion pod 218 engages along the medial side 220 of the intermediate plate 256. In some examples, the rear wall 416 of the cushion pods 214, 218 extends obliquely between the upper plate 254 and the intermediate plate 256. In some examples, the cushion pods 214, 218 are arranged to be collinear with the CM point 235 of the footwear 200.

Further, referring to FIG. 4, an overall length or total length OL of the footwear 200 measured between a toe plane TP and a heel plane HP is shown. The upper plate 254 extends away from the toe plane TP toward the heel end 238 a first distance 418 and the intermediate plate 256 extends away from the toe plane TP toward the heel end 238 a second distance 419. In the illustrated embodiment, the second distance 419 is greater than the first distance 418. The lower plate 258 extends away from the toe plane TP toward the heel end 238 a third distance 420, which is equal to the second distance 419 and, thus, is represented by the same illustrative arrows in FIG. 4 as the second distance 419. In some embodiments, the third distance 420 and the second distance 419 can be different (e.g., one can be greater than the other). Furthermore, the CM point 235 is disposed at a fourth distance 421 away from the toe plane TP. In some examples, the fourth distance 421 may be smaller than the second distance 419, or the third distance 420, or both. In some examples, the fourth distance 421 may be smaller than each of the first, second, and third distances 418, 419, 420.

Referring now to FIG. 11, the heel cushion 210 surrounding the upper 202, the shank 252, and the insole 260 is shown. Similar to the forefoot cushion 206, the heel cushion includes the heel recess 380 that is configured to receive the shank 252 and the insole 260. In the illustrated example, the recessed surface 364 is disposed opposite of the heel recess 380 in a form of a channel.

Figure 12:
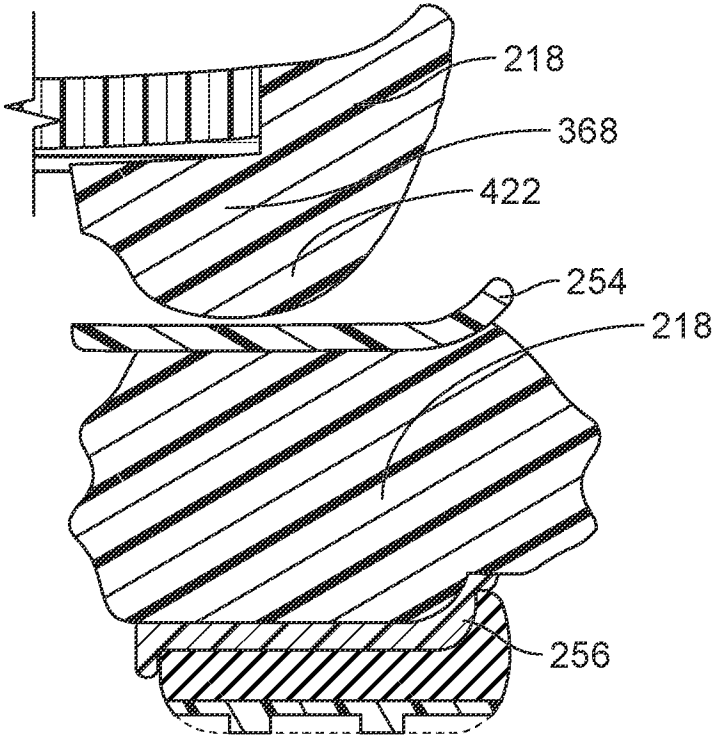
FIG. 12 is a cross-sectional view of the article of footwear along 12-12 of FIG. 6.

FIG. 12 illustrates a medial arm nub 422 of the medial cushion pod 218 abutting the upper plate 254 along a cross-section. In some embodiments, the medial arm nub 422 of the medial arm 368 rests freely on the upper top surface of the upper plate 254. In some embodiments, the medial arm nub 422 of the medial arm 368 is secured or attached to the upper top surface of the upper plate 254, such as, e.g., using adhesives, fasteners, or welding, or another suitable technique. The medial cushion pod 218 is disposed between the upper plate 254 and the intermediate plate 256 such that the medial cushion top surface 338 of the medial cushion pod 218 is partially retained within a medial upper lip 426 and the medial cushion bottom surface 340 that is partially retained within the medial intermediate lip 400.

Similarly, referring to FIG. 4, a lateral arm nub 432 of the heel cushion 210 is partially retained within a lateral upper lip 424. In other words, the upper posterior end 268 of the upper plate 254 abuts the medial arm nub 422 of the medial arm 368 (e.g., opposite of the lateral arm nub) and the lateral arm nub 432 of the lateral arm 366 along the midfoot region 226 of the sole structure 204. Further, the intermediate gap 222 is formed between the shank 252 and the upper plate 254 between the forefoot cushion posterior end 280 and the nubs 422, 432 along the heel cushion anterior end 282. A lower forward gap 442 is formed between the front wall 414 of the cushion pods 214, 218 and the diverging point DP and a lower rear gap 444 is formed between the rear wall of the cushion pods 214, 218 and the heel cushion 210.

The cushion top surfaces 334, 338 of the cushion pods 214, 218 are attached to the upper bottom surface 304 of the upper plate 254 by an adhesive, fasteners, welding, or other suitable techniques. Referring to FIG. 5, in some embodiments, the cushion top surfaces 334, 338 at the top of the cushion pods 214, 218 includes an upper lateral pod retaining region 446 and an upper medial pod retaining region 447 to establish a connection between upper posterior end of the upper plate 254 and the cushion pods 214, 218. In the illustrated embodiment, the upper lateral pod retaining region 446 and the upper medial pod retaining region 447 are disposed along the cushion top surfaces 334, 338 at the top of the cushion pods 214, 218 in a form of a groove. Similarly, the cushion bottom surfaces 336, 340 of the cushion pods 214, 218 and the intermediate top surface 306 of the intermediate plate 256 can be connected by adhesives. In some embodiments, the intermediate top surface 306 directly beneath the cushion pods 214, 218 may include a lower lateral pod retaining region 448 and a lower medial pod retaining region 449 to establish a connection between the intermediate plate 256 and the cushion pods 214, 218. The cushion pods 214, 218 can be adhered within the upper and lower pod retaining regions 446, 447 448, 449 by an adhesive or a fastener.

Referring now to FIG. 10, a medial outer side wall 450 of the medial cushion pod 218 protrudes beyond the medial side 220 of the heel cushion 210 and the medial intermediate lip 400. However, a lateral outer side wall 452 of the lateral cushion pod 214 protrudes beyond the lateral intermediate lip 398 but does not protrude beyond the lateral side 216 of the heel cushion 210. Further a medial inner side wall 454 protrudes beyond the intermediate cutout 288 by a first dimension 455, and a lateral inner side wall 456 protrudes beyond the intermediate cutout 288 by a second dimension 457, the first dimension 455 being less than the second dimension 457. In other words, additional material is disposed toward the direction of the medial side 220 of the footwear in order to provide stability when the footwear 200 strikes the ground surface.

Figure 13:
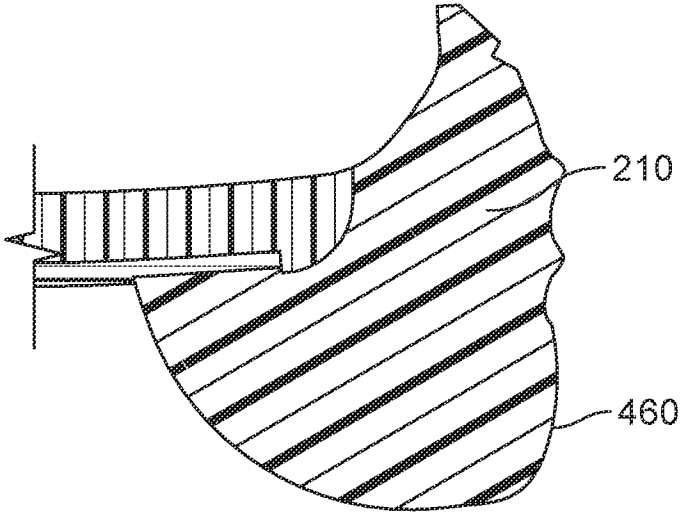
FIG. 13 is a cross-sectional view of the article of footwear along 12-12 of FIG. 6.

Referring now to FIG. 13, illustrates a cross-section of the heel cushion 210 including one or more ridges (e.g., undulated surface) along an outer heel surface 460 of the heel cushion 210. Further the shank 252 can be exposed between along the bridge portion 228. As illustrated in FIGS. 6 and 7, a portion of the shank 252 is revealed between the lower posterior end 276 of the lower plate 258 and the heel cushion anterior end 282 of the heel cushion 210. Referring to FIG. 7, a thickness t1 of the shank 252 may vary between the toe end 236 and the heel end 238. In some examples, the thickness t1 of the shank 252 may be uniform between the toe end 236 and the heel end 238. In some examples, a thickness t2 of the insole 260 may be uniform between the toe end 236 and the heel end 238. In some examples, the thickness t2 of the insole 260 may vary between the toe end 236 and the heel end 238. In some examples, a thickness t3 of the forefoot cushion 206 and the heel cushion 210 may vary between opposing ends along the longitudinal direction. In some examples, the thickness t3 of the forefoot cushion 206 and the heel cushion 210 may be uniform between the opposing ends along the longitudinal direction. In some examples, a thickness t4 of the plurality of plates 230 may vary between opposing ends along the longitudinal direction. In some examples, the thickness t4 of the plurality of plates 230 may be uniform between opposing ends along the longitudinal direction. In some examples, a thickness t5 of the forward outsole portion 232 and the rearward outsole portion 234 may vary between opposing ends along the longitudinal direction. In some examples, the thickness t5 of the forward outsole portion 232 and the rearward outsole portion 234 may vary between opposing ends along the longitudinal direction.

Figure 14:
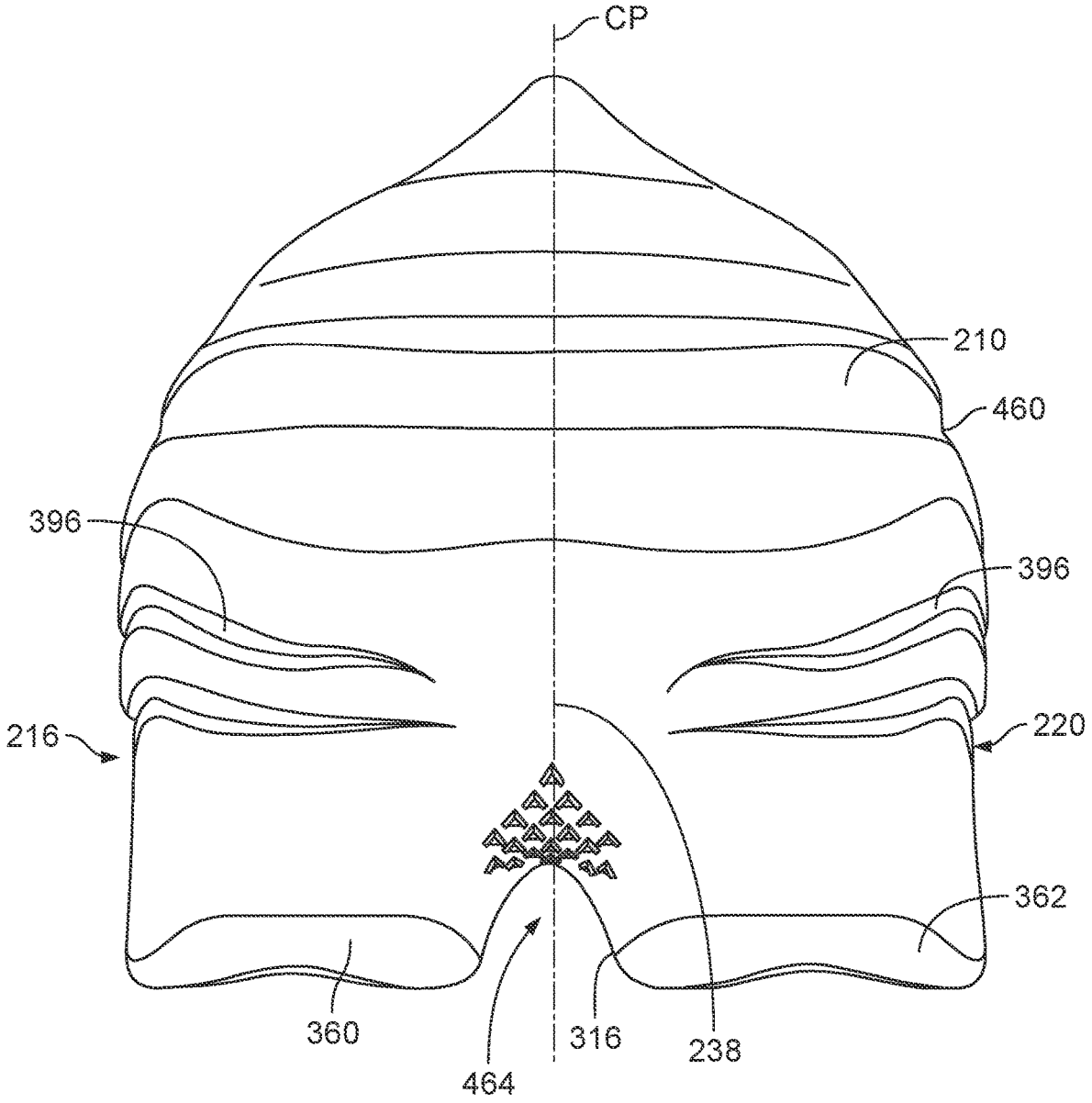
FIG. 14 is a rear elevational view of the article of footwear of FIG. 4.

Referring now to FIG. 14, the heel end 238 of the heel cushion 210 is shown. In the illustrated example, the lateral heel outsole section 360 and the medial heel outsole section 362 wraps partially around the heel cushion 210 adjacent to the heel cushion bottom surface 324. Between the lateral heel outsole section 360 and the medial heel outsole section 362, a channel 464 is formed between the heel cushion anterior end 282 and the heel cushion posterior end 284. As described above, the outer heel surface 460 of the heel cushion 210 may include one or more of the plurality of ridges 396 that extends along the lateral side 216 and the medial side 220 of the heel cushion 210. In some embodiments, the one or more of the plurality of ridges 396 along the lateral side 216 may be symmetrical with the one or more of the plurality of ridges 396 along the medial side 220 of the heel cushion about the central plane CP that extends along the longitudinal axis LA. In some embodiments, the one or more of the plurality of ridges 396 along the lateral side 216 may be asymmetrical with the medial side 220 of the heel cushion 210 about the central plane CP.

Similarly, referring back to FIGS. 8 and 9, the plurality of ridges 396 disposed on the lateral side 216 of an outmost surface 470 of the forefoot cushion 206 can be symmetrical with the plurality of ridges 396 disposed on the medial side 220 of the outmost surface 470 of the forefoot cushion 206. Alternatively, referring to FIG. 9, the plurality of ridges 396 disposed on the lateral side 216 of an outmost surface 470 of the forefoot cushion 206 can be asymmetrical with the plurality of ridges 396 disposed on the medial side 220 of the outmost surface 470 of the forefoot cushion 206. In some embodiments, the plurality of ridges 396 may extend along an inner most surface 472 of the forefoot cushion that is opposite of the outmost surface 470.

The plurality of plates 230 described above can be formed from a thermoplastic material, such as a thermoplastic polyurethane, a thermoplastic elastomer, a thermoplastic olefin, or the like. In particular aspects, however, the plurality of plates 230 may be formed from a composite or one or more layers of fibers, such as carbon fibers, aramid fibers, boron fibers, glass fibers, natural fibers, and polymer fibers, or a combination thereof. In some examples, the fibers may be affixed or bonded to a substrate or a thermoplastic material, e.g., a thermoplastic polyurethane, a thermoplastic polyolefin, or a thermoplastic elastomer, by stitching or an adhesive. In other examples, the plurality of plates 230 may be formed from a unidirectional tape that includes carbon fibers, aramid fibers, boron fibers, glass fibers, polymer fibers, or the like. In yet other examples, plurality of plates 230 may be formed from densified wood or densified wood panels formed from chemically treating natural wood to remove lignin or hemicellulose therefrom, or compressing natural wood.

In some aspects, one or more materials of the plurality of plates 230 have a stiffness (e.g., a tensile strength) defined by a Young's modulus. For example, the one or more materials forming the plurality of plates 230 may have a Young's modulus of at least about 25 gigapascals (GPa), at least about 40 GPa, or at least about 70 GPa, or at least about 85 GPa, or at least about 200 GPa. In other examples, the one or more materials forming the plurality of plates 230 may have a Young's modulus between about 25 GPa and about 200 GPa, or between about 25 GPa and about 80 GPa, or between about 25 GPa and about 70 GPa, or between about 50 GPa and about 75 GPa. In some aspects, the plurality of plates 230, and the stiffness thereof, may be selected and designed for a particular user. For example, a stiffness of the plurality of plates 230 may be selected based on the particular muscle strength, tendon flexibility, or joint flexibility of a user. In some aspects, the stiffness of the plurality of plates 230 may vary, such that a portion of the plurality of plates 230 is stiffer compared to another portion of the plurality of plates 230.

As disclosed herein, the article of footwear 200 includes the multi-plate, toe-weighted, bifurcated sole structure 204 comprising the forefoot cushion 206, the heel cushion 210, the shank 252, the upper plate 254, the intermediate plate 256, the lower plate 258, the insole 260, the lateral cushion pod 214, and the medial cushion pod 218. Each of the upper plate 254, the intermediate plate 256, and the lower plate 258 has portion that contacts the forefoot cushion 206. The upper plate 254 varies in curvature in the longitudinal direction between the upper anterior end 266 and the upper posterior end 268, such that the upper plate 254 defines at least two different radii of curvatures therealong and includes the upper transition point UT1 between the concave portion and the convex portion. The upper plate 254 diverges in curvature from the intermediate plate 256 at the divergent point DP to form the divergent configuration 383 that accommodates the lateral cushion pod 214 and the medial cushion pod 218 being disposed between the upper plate 254 and the intermediate plate 256. The shank 252 also includes the shank bridge portion 382 in the form a thickened area that spans the intermediate gap 222 in the midfoot region 226 to connect the heel cushion 210 to the forefoot cushion 206.

As a result of the location, size, and materials of the forefoot cushion 206 and the plurality of plates 230, including the upper plate 254, the intermediate plate 256, and the lower plate 258, as well as the location, size, and materials of the lateral cushion pod 214 and the medial cushion pod 218, the article of footwear 200 is arranged to distribute mass so that the CM point 235 is positioned in the midfoot region 226 and closer to the toe end 236 than to the heel end 238 of the sole structure 204, which affords the article of footwear 200 the ability rest to only on the forward outsole portion 232 so that the rearward outsole portion 234 is cantilevered and elevated the distance D1 above the planar surface P.

In some embodiments, the forefoot cushion 206 and heel cushion 210 provide different cushioning properties, such as, e.g., stiffness, density, abrasion resistance, puncture resistance, and the like. In some embodiments, the forefoot cushion 206 and the heel cushion 210 are formed of different materials from one another to provide the different cushioning properties. It will be appreciated that the sole structure 204 and/or the plurality of plates 230 may be fabricated using various manufacturing techniques, including additive manufacturing, e.g., continuous fiber fabrication (CFF), binder jetting, direct energy deposition, selective laser melting (SLM), fused deposition modeling (FDM), electron beam melting, laser powered bed fusion (LPBF), ultrasonic additive manufacturing, material extrusion, material jetting, Joule printing, electrochemical deposition, cold spray metal printing, DLP metal printing, Ultrasonic Consolidation or Ultrasonic Additive Manufacturing (UAM), LENS laser-based printing, vat photopolymerization, sheet lamination, or electron beam freeform fabrication (EBF3). Further, the sole structure 204 and/or the plurality of plates 230 may be fabricated by injection molding, vulcanization, or any other suitable methods used in the industry.

In other aspects, other configurations are possible. For example, certain features and combinations of features that are presented with respect to particular aspects in the discussion above can be utilized in other aspects and in other combinations, as appropriate. Further, any of the aspects described herein may be modified to include any of the structures or methodologies disclosed in connection with other aspects. Additionally, the present disclosure is not limited to articles of footwear of the type specifically shown. Still further, aspects of the articles of footwear of any of the aspects disclosed herein may be modified to work with any type of footwear, apparel, or other athletic equipment.

As noted previously, it will be appreciated by those skilled in the art that while the invention has been described above in connection with particular aspects and examples, the invention is not necessarily so limited, and that numerous other aspects, examples, uses, modifications and departures from the aspects, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A sole structure for an article of footwear, comprising:

a first plate having a first anterior end disposed adjacent a toe end of the sole structure and a first posterior end disposed within a heel region of the sole structure;

a second plate having a second anterior end disposed adjacent the toe end and a second posterior end disposed in a midfoot region of the sole structure;

a third plate having a third anterior end disposed adjacent the toe end and a third posterior end disposed in the midfoot region; and a rubber outsole having a top surface that is in contact with a bottom surface of the third plate, wherein a first cushion is arranged between and contacts both the first plate and the second plate, and wherein the second plate and the third plate are in contact with one another and are coplanar in a forefoot region.

2. The sole structure of claim 1, wherein the second plate and the third plate diverge from one another at a divergent point that is located in the forefoot region.

3. The sole structure of claim 2, wherein the second plate curves concavely relative to the first cushion between the second anterior end and a transition point that is spaced toewardly from the second posterior end.

4. The sole structure of claim 3, wherein the second plate curves convexly relative to the first cushion between the transition point and the second posterior end.

5. The sole structure of claim 4, wherein the transition point is positioned heelward of the divergent point.

6. The sole structure of claim 5, wherein the transition point is positioned heelward of a metatarsophalangeal (MTP) point.

7. The sole structure of claim 1, wherein a center of mass point of the article of footwear is positioned in a midfoot region and distanced from the toe end between about 50% and about 60% of a total length of the sole structure.

8. A sole structure for an article of footwear, comprising:

a first plate extending from a forefoot region to a heel region;

a second plate coupled to an outsole in the forefoot region;

a forefoot cushion supporting an anterior end of the first plate in the forefoot region; and a heel cushion supporting a posterior end of the first plate, wherein a gap is formed between the forefoot cushion and the heel cushion, wherein the first plate forms a bridge portion that spans the gap in a midfoot region to connect the forefoot cushion to the heel cushion, and wherein the first plate includes a rib that protrudes from the bridge portion along an underside of the first plate and provides additional thickness to the first plate.

9. The sole structure of claim 8, wherein the rib is exposed through the gap from a bottom of the sole structure.

10. The sole structure of claim 9, wherein an insole overlies the first plate, the insole and the first plate being retained within a forefoot recess formed in the forefoot cushion and a heel recess formed in the heel cushion.

11. The sole structure of claim 8, wherein the heel cushion includes a medial arm and a lateral arm that are coupled to a third plate that is disposed between the first plate and the second plate.

12. The sole structure of claim 11, wherein the second plate contacts a bottom surface of the forefoot cushion.

13. The sole structure of claim 11, wherein the second plate and the third plate curve concavely relative to the forefoot cushion between a toe end of the sole structure and a divergent point that is located in the forefoot region.

14. The sole structure of claim 13, wherein a center of mass point of the article of footwear is positioned in the midfoot region and distanced from the toe end between about 50% and about 60% of a total length of the sole structure.

15. A sole structure for an article of footwear, comprising:

a lateral cushion pod engaged with a lateral portion of a first plate; and a medial cushion pod engaged with a medial portion of the first plate, wherein the first plate has a top surface in contact with a forefoot cushion, wherein a bottom surface of the first plate contacts a second plate adjacent a toe end, and wherein both the lateral cushion pod and the medial cushion pod are arranged to be collinear with a center of mass point of the footwear.

16. The sole structure of claim 15, wherein the center of mass point of the article of footwear is positioned in a midfoot region and distanced from the toe end between about 50% and about 60% of a total length of the sole structure.

17. The sole structure of claim 15, wherein the first plate and the second plate curve concavely relative to the forefoot cushion between the toe end and a divergent point that is positioned toeward of the center of mass point.

18. The sole structure of claim 17, wherein the first plate curves convexly between a transition point and a first posterior end that is located in a midfoot region.

19. The sole structure of claim 18, wherein the first plate includes a first cutout and a second plate includes a second cutout, the first cutout being axially aligned with the second cutout of the second plate.

20. The sole structure of claim 19, wherein the sole structure has a forward outsole portion that rests on a ground surface and a rearward outsole portion that is cantilevered above the ground surface.

* * * * *